US010361027B2

(12) United States Patent
Kinoshita et al.

(10) Patent No.: US 10,361,027 B2
(45) Date of Patent: Jul. 23, 2019

(54) IGNITION DEVICE

(71) Applicant: DENSO CORPORATION, Kariya, Aich-pref. (JP)

(72) Inventors: Shota Kinoshita, Nisshin (JP); Kazuki Fukatsu, Nisshin (JP); Fumiaki Aoki, Nisshin (JP); Akimitsu Sugiura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/077,526

(22) PCT Filed: Dec. 20, 2016

(86) PCT No.: PCT/JP2016/087955
§ 371 (c)(1),
(2) Date: Aug. 13, 2018

(87) PCT Pub. No.: WO2017/141541
PCT Pub. Date: Aug. 24, 2017

(65) Prior Publication Data

US 2019/0057808 A1 Feb. 21, 2019

(30) Foreign Application Priority Data

Feb. 15, 2016 (JP) ..... 2016-026321

(51) Int. Cl.
*F02P 15/00* (2006.01)
*H01F 27/36* (2006.01)
(Continued)

(52) U.S. Cl.
CPC ..... *H01F 27/365* (2013.01); *F02P 3/01* (2013.01); *F02P 15/00* (2013.01); *H01F 27/02* (2013.01);
(Continued)

(58) Field of Classification Search
CPC ..... F02P 15/00; F02P 15/003; F02P 15/08; F02P 3/01; F02P 3/02; F02P 7/03;
(Continued)

(56) References Cited

U.S. PATENT DOCUMENTS 3,517,655 A * 6/1970 Jaulmes ..... F02P 1/086 123/149 R
3,529,587 A * 9/1970 Sasayama ..... F02P 3/0884 123/598
(Continued)

FOREIGN PATENT DOCUMENTS

JP 62-145982 9/1987
JP 7-97974 4/1995
(Continued)

*Primary Examiner* — Haissa Philogene
(74) *Attorney, Agent, or Firm* — Nixon & Vanderhye PC

(57) ABSTRACT

A step-up transformer, an oscillator, and an ignition plug are comprised. The step-up transformer has a primary winding, a secondary winding, and a core. The ignition plug is connected to a first end of the secondary winding. A gap is formed in the core. The step up transformed is provided with a shielding part which is made of a conductive material and shields the magnetic flux leaking from the gap. A second end of the secondary winding is electrically connected to the shielding part.

20 Claims, 20 Drawing Sheets

(51) Int. Cl.

| | |
|---|---|
| ***H01F 38/12*** | (2006.01) |
| ***F02P 3/01*** | (2006.01) |
| ***H01F 27/02*** | (2006.01) |
| ***H01F 27/24*** | (2006.01) |
| ***H01F 27/28*** | (2006.01) |

(52) U.S. Cl.
CPC ..... *H01F 27/24* (2013.01); *H01F 27/28* (2013.01); *H01F 38/12* (2013.01)

(58) Field of Classification Search
CPC ..... F02P 7/035; F02P 1/086; F02P 2017/125; H01F 38/12; H01F 27/02; H01F 27/24; H01F 27/28; H01F 27/365
See application file for complete search history.

(56) References Cited

U.S. PATENT DOCUMENTS

| | | | | |
|---|---|---|---|---|
| 4,509,495 | A | 4/1985 | Betz et al. | |
| 5,179,928 | A * | 1/1993 | Cour | F02P 9/002 123/598 |
| 5,456,241 | A * | 10/1995 | Ward | F02P 3/0892 123/169 EL |
| 5,615,659 | A | 4/1997 | Morita et al. | |
| 5,649,507 | A * | 7/1997 | Gregoire | C02F 1/4608 123/143 B |
| 8,552,651 | B2 * | 10/2013 | Sugino | H05H 1/46 315/111.41 |
| 9,484,719 | B2 * | 11/2016 | Zheng | H01T 19/04 |
| 10,006,433 | B2 * | 6/2018 | Kanehara | F02B 19/12 |
| 2009/0188458 | A1 | 7/2009 | Visser et al. | |
| 2012/0192624 | A1 | 8/2012 | Visser et al. | |

FOREIGN PATENT DOCUMENTS

| | | |
|---|---|---|
| JP | 8-144919 | 6/1996 |
| JP | 9-232161 | 9/1997 |

* cited by examiner

IGNITION DEVICE

CROSS-REFERENCE TO RELATED APPLICATIONS

This application is the U.S. national phase of International Application No. PCT/JP2016/087955 filed on Dec. 20, 2016 which designated the U.S. and claims priority to based on Japanese Application No. 2016-26321 filed on Feb. 15, 2016, the entire contents of each of which are incorporated herein by reference.

TECHNICAL FIELD

The present disclosure relates to an ignition device comprising a step-up transformer having a primary winding and a secondary winding, an oscillator connected to the primary winding, and an ignition plug connected to the secondary winding.

BACKGROUND ART

An ignition device for an internal combustion engine, having a step-up transformer having a primary winding and a secondary winding, an oscillator connected to the primary winding, and an ignition plug connected to the secondary winding is known (see PTL 1 specified below). When a primary voltage is applied to the primary winding using the oscillator, a secondary voltage is generated at the secondary winding. According to this ignition device, as described later, a high secondary voltage is generated by making use of the resonance phenomenon caused by the leakage inductance of the secondary winding and the stray capacitance parasitic to the leakage inductance. Using this high secondary voltage, electric discharge is generated by the spark plug.

The step-up transformer includes a core made of a soft magnetic material. As described later, the core is provided with a gap for purposes such as making the self-resonant frequency of the secondary winding higher. However, due to the gap, when the step-up transformer is driven, there tends to be problems such as the magnetic flux leaks from the gap, the resonance gain of the secondary voltage decreases, and electromagnetic noise occurs.

Thus, in recent years, attempts have been made to shield the leakage magnetic flux generated from the gap by providing a shielding part made of a conductive material. This configuration intends to thereby suppress electromagnetic noise. In addition, when the leakage magnetic flux is blocked by the shielding part, an induced voltage is generated in the shielding part and a current flows, resulting in the generation of magnetic flux (hereinafter also referred to as induced magnetic flux). Since a part of the induced magnetic flux returns to the core, it can be considered that the resonance gain of the secondary voltage can be improved.

CITATION LIST

Patent Literature

[PTL 1] Japanese Unexamined Patent Application Publication No. H5-121254

However, results from studies performed by the inventors, found that the resonance gain of the secondary voltage cannot be improved sufficiently by only providing the shielding part. That is, when the shielding part is merely provided and the shielding part and the secondary winding are not electrically connected, the electrical potential of the shielding part is affected by factors such as the electromagnetic noise generated from the step-up transformer, and oscillates with respect to the reference potential of the secondary winding. Therefore, there will be a phase shift between the secondary voltage generated at the secondary winding and the induced voltage generated at the shielding part. Thus, even if a part of the induced magnetic flux generated from the shielding part returns to the core, since there is a phase shift between the induced magnetic flux and the secondary voltage, it cannot contribute to the resonance of the secondary voltage.

SUMMARY

The present disclosure has been made in view of the above background, and an object thereof is to provide an ignition device that can more efficiently resonate the secondary voltage of the step-up transformer and easily cause the ignition plug to generate electrical discharge.

Solution to Problem

A first aspect of the present disclosure resides in an ignition device having a step-up transformer including a primary winding, a secondary winding, and a core made of a soft magnetic material having a gap; an oscillator connected to the primary winding; an ignition plug connected to a first end of the secondary winding; and a shielding part made of a conductive material and shielding magnetic flux leaking from the gap. The ignition device is configured to cause the ignition plug to generate discharge by applying an alternating voltage to the primary winding by the oscillator and cause a secondary voltage generated in the secondary winding to resonate, and a second end of the secondary winding, which is the end opposite to the first end, is electrically connected to the shielding part.

Effect of the Invention

In the above-described ignition device, the second end of the secondary winding is electrically connected to the shielding part.

Therefore, it is possible to make the potential of the second end of the secondary winding and the potential of the shielding part the same. Thus, it is possible to suppress the potential of the shielding part oscillating with respect to the reference potential of the secondary winding, that is, the potential of the second end. Thus, it is possible to make the phases of the induced voltage generated in the shielding part by the magnetic flux that has leaked from the gap and the secondary voltage match. Accordingly, the phases of the induced magnetic flux returning to the core from the shielding part and the secondary voltage can be matched with each other, which allows the secondary voltage to resonate more effectively. Therefore, a high secondary voltage can be obtained, and the spark plug can be discharged easier.

As described above, according to the present aspect, an ignition device that can more efficiently resonate the secondary voltage of the step-up transformer and easily cause the ignition plug to generate electrical discharge can be provided.

BRIEF DESCRIPTION OF THE DRAWINGS

The above and other objects, features, and advantages of the present disclosure will become clearer from the following detailed description with reference to the accompanying drawings. In the drawings.

DESCRIPTION OF THE EMBODIMENTS

The ignition device can be an in-vehicle ignition device used in an internal combustion engine of a vehicle.

First Embodiment

Figure 1:
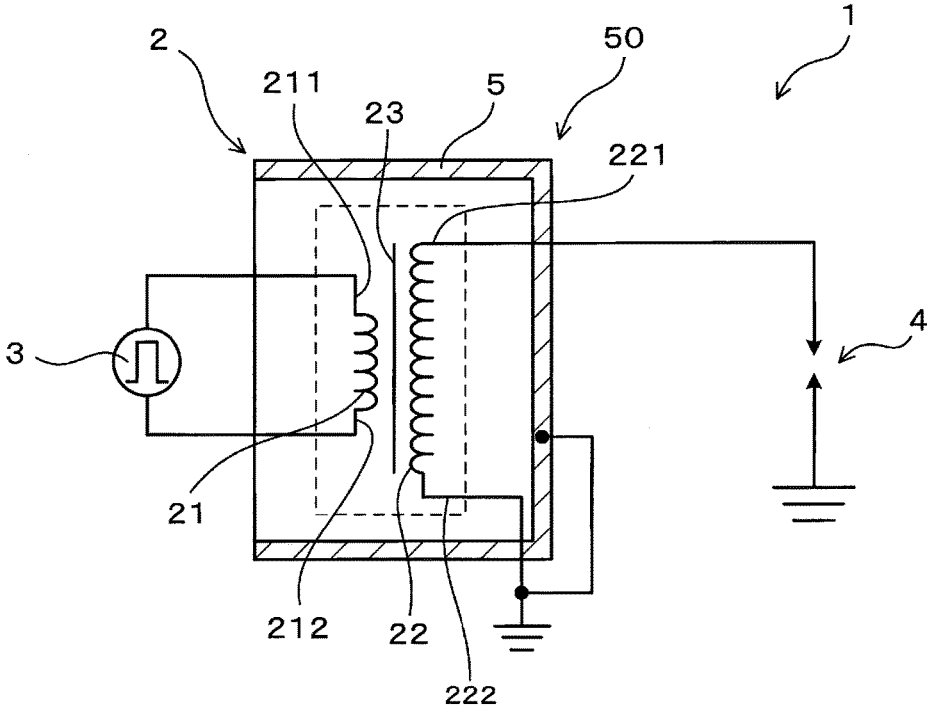
FIG. 1 is a conceptual view of an ignition device according to a first embodiment.

An embodiment according to the above-described ignition device will be described with reference to FIGS. 1-12. As shown in FIG. 1, an ignition device 1 of this embodiment includes a step-up transformer 2, an oscillator 3, a spark plug 4, and a shielding part 5. The step-up transformer 2 has a primary winding 21, a secondary winding 22, and a core 23. The oscillator 3 is connected to the primary winding 21. The spark plug 4 is connected to a first end 221 of the secondary winding 22.

Figure 2:
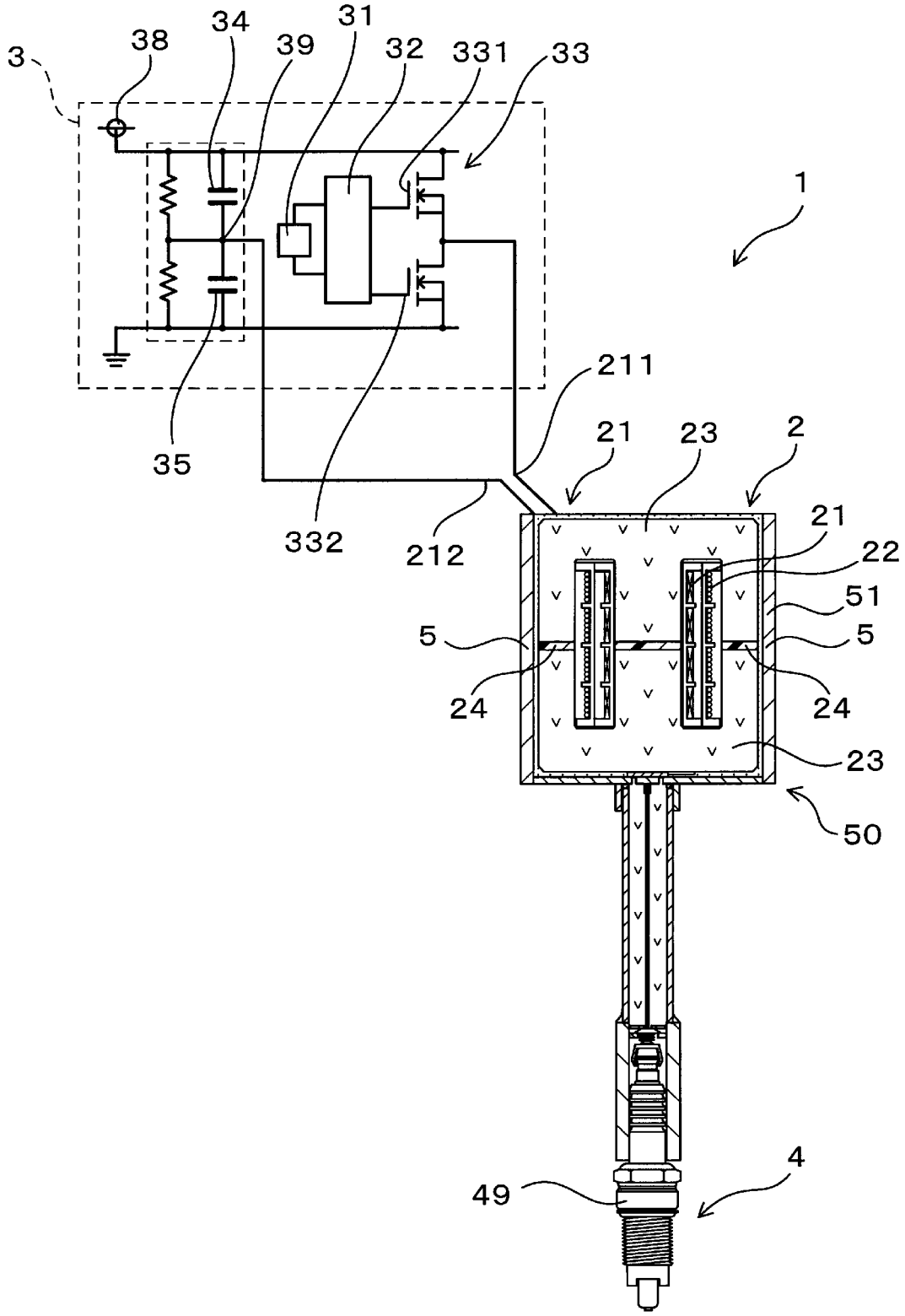
FIG. 2 shows cross sections of some components and a circuit diagram of an oscillator according to the first embodiment.
Figure 3:
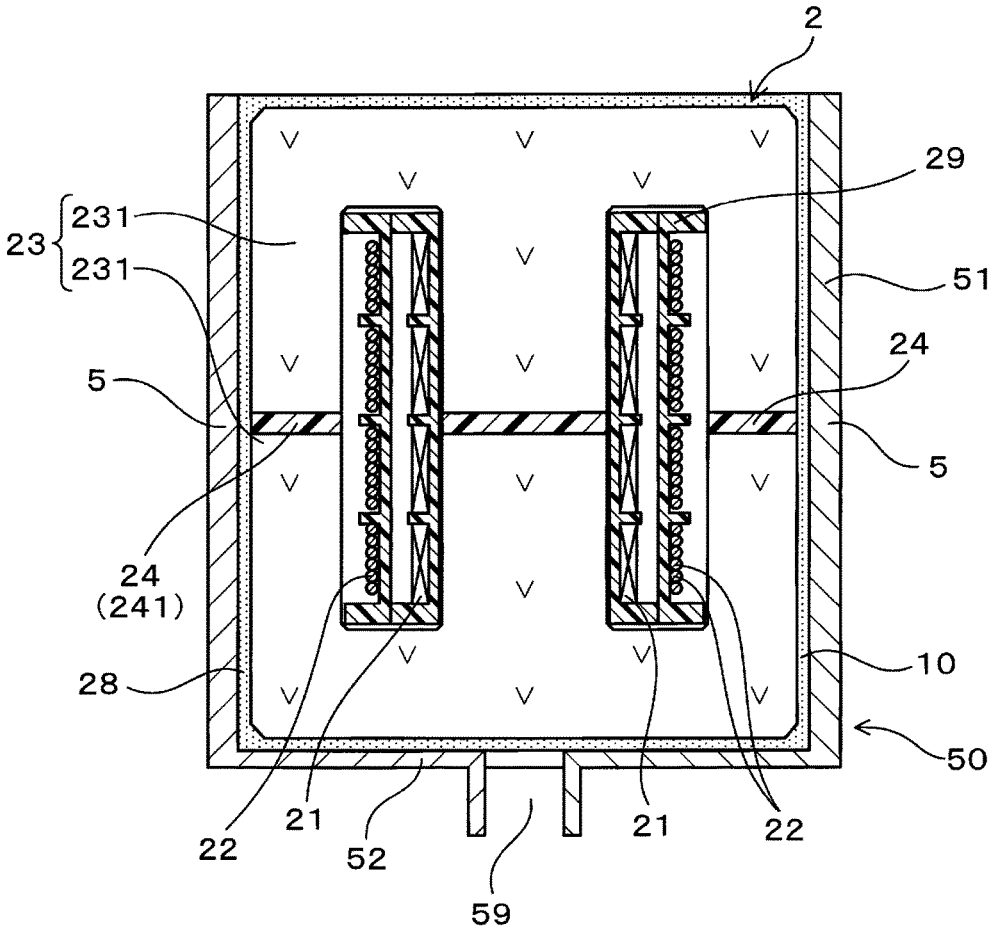
FIG. 3 is a cross-sectional view of a step-up transformer and the case according to the first embodiment.

As shown in FIG. 2 and FIG. 3, a gap 24 is formed in the core 23. The core 23 is made of a soft magnetic material.

The shielding part 5 is made of a conductive material and shields the magnetic flux $\varphi_L$ leaking from the gap 24.

The ignition device 1 is configured to apply an alternating voltage to the primary winding 21 by the oscillator 3 and cause the secondary voltage $V_2$ generated in the secondary winding 22 resonate to make the spark plug 4 generate discharge.

As shown in FIG. 1, a second end 222 of the secondary winding 22, which is the end opposite to the first end 221, is electrically connected to the shielding part 5.

The ignition device 1 of this embodiment is an in-vehicle ignition device for use in an internal combustion engine of a vehicle. As shown in FIGS. 1 and 2, the ignition device 1 comprises the case 50 for accommodating the step-up transformer 2. The case 50 constitutes the shielding part 5.

When an alternating voltage is applied to the primary winding 21 using the oscillator 3, a secondary voltage $V_2$ is generated in the secondary winding 22. In addition, there is a stray capacitance $C_0$ (see FIG. 7) described later parasitic on the secondary winding 22. Since this stray capacitance $C_0$ and the leakage inductance $L_{L2}$ of the secondary winding 22 cause a resonance phenomenon, a high secondary voltage $V_2$ is generated. That is, a secondary voltage $V_2$ that is higher than a value obtained by multiplying the turn ratio $N_2/N_1$ of the primary winding 21 and the secondary winding 22 by the primary voltage $V_1$ is generated by the resonance. Using this secondary voltage $V_2$, electric discharge is caused by the spark plug 4. Incidentally, the spark plug 4 of this embodiment is a so-called creeping discharge plug.

Next, the structure of the step-up transformer 2 will be described. As shown in FIG. 3, the core 23 used in the step-up transformer 2 of this embodiment is an EE core formed by combining two E-shaped core pieces 231. Between the two core pieces 231, a gap forming member 241 made of resin or the like is interposed. This gap forming member 241 forms the gap 24 between the two core pieces 231.

In addition, a bobbin 29 is provided in the core 23. The primary winding 21 and the secondary winding 22 are wound around the bobbin 29. In addition, the step-up transformer 2 is sealed by a sealing member 28 in the case 50.

As shown in FIG. 3, the case 50 includes a bottom part 52 and a wall part 51 rising upwards from the bottom part 52. The bottom part 52 and the wall part 51 are made of metal. A plug connecting opening 59 for electrically connecting the secondary winding 22 to the spark plug 4 (see FIG. 2) is formed in the bottom part 52.

Figure 4:
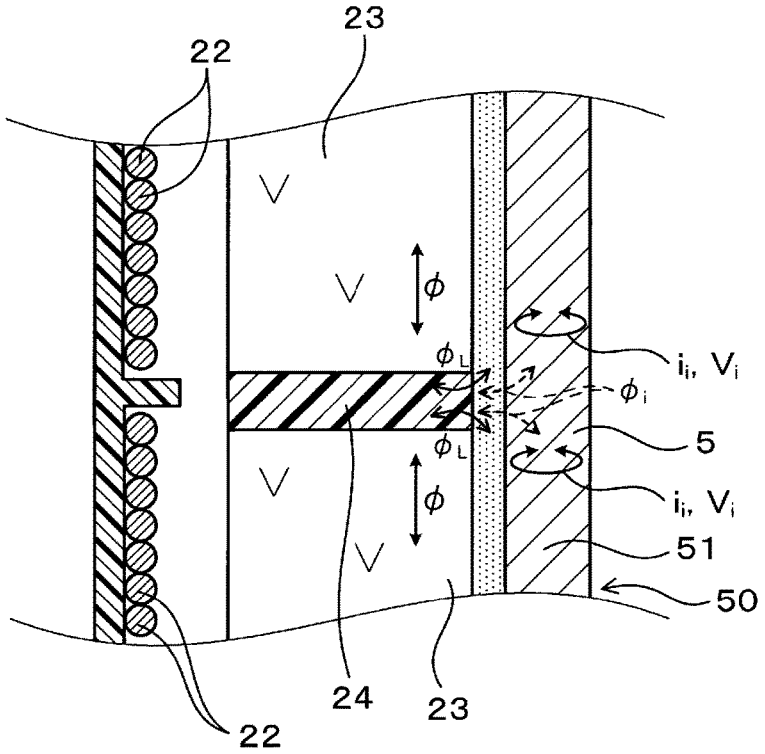
FIG. 4 is an enlarged view of the main part of FIG. 3.

When a primary current $I_1$ flows through the primary winding 21, a magnetic flux φ flows through the core 23, and a secondary voltage $V_2$ is generated in the secondary winding 22, as shown in FIG. 4. A part of the magnetic flux φ leaks from the gap 24 and becomes a leakage magnetic flux $\varphi_L$ Since the leakage magnetic flux $\varphi_L$ interlinks with the shielding part 5, an induced voltage $V_i$ is generated in the shielding part 5, and an induced current $i_i$ flows. Therefore, an induced magnetic flux $\varphi_i$ is generated from the shielding part 5. A part of the induced magnetic flux $\varphi_i$ returns to the core 23.

In this embodiment, as described above, the second end 222 of the secondary winding 22 and the shielding part 5 are electrically connected. Thus, it is possible to make the potentials of the second end 222 and the shielding part 5 equal to each other, and make the phases of the secondary voltage $V_2$ and the induced voltage $V_i$ match. Therefore, the phases of the induced magnetic flux $\varphi_i$ and the secondary voltage $V_2$ can be matched with each other, which makes it possible to further strengthen the resonance of the secondary voltage $V_2$ by the induced magnetic flux $\varphi_i$.

Figure 5:
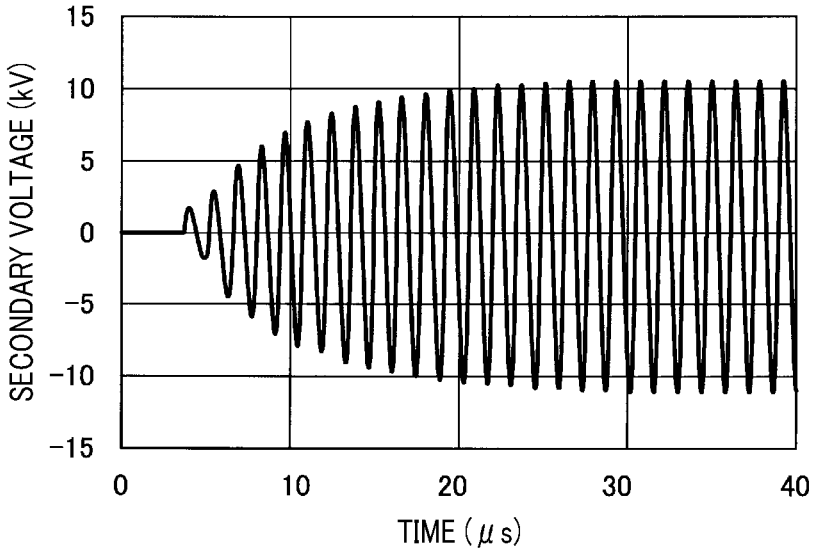
FIG. 5 is a waveform graph of the secondary voltage according to the first embodiment.
Figure 6:
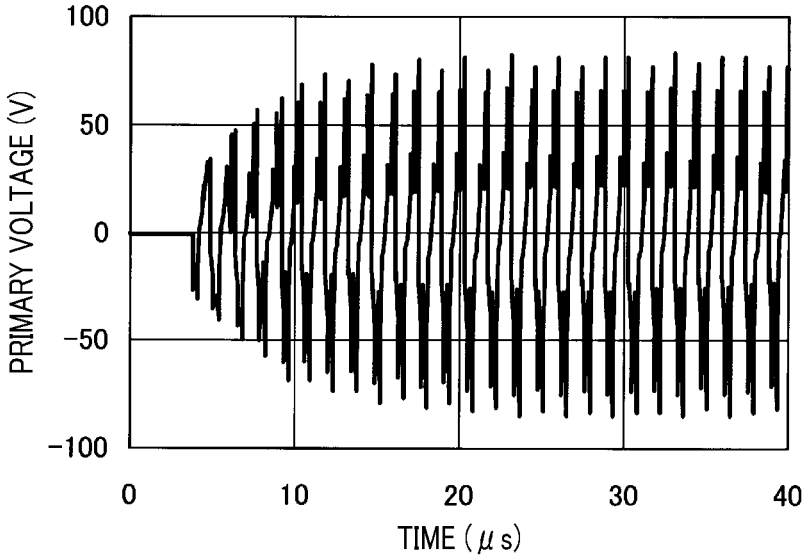
FIG. 6 is a waveform graph of the primary voltage according to the first embodiment.
Figure 27:
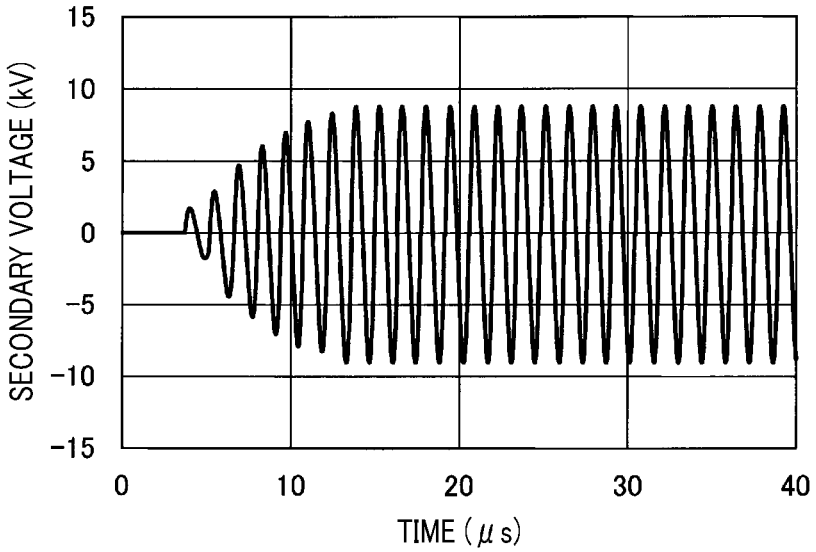
FIG. 27 is a waveform graph of the secondary voltage according to a comparative example and FIG. 28 is a waveform graph of the primary voltage according to a comparative example.
Figure 28:
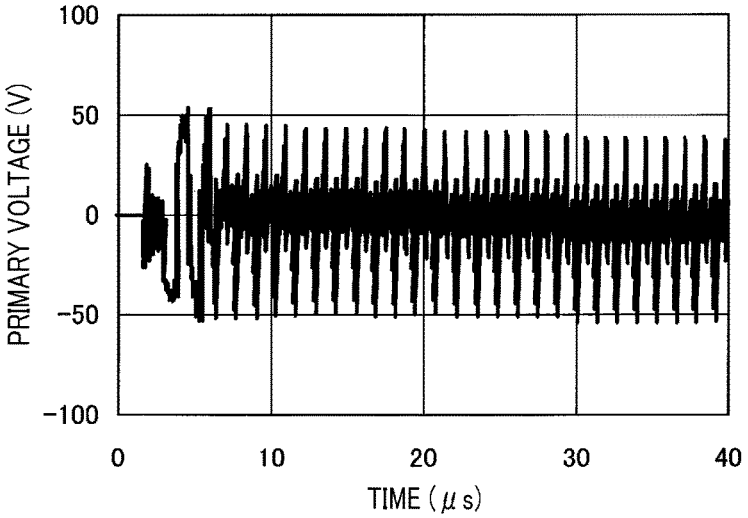

FIGS. 5 and 6 show waveforms of the secondary voltage $V_2$ and the primary voltage $V_1$. FIGS. 27 and 28 show waveforms of the secondary voltage $V_2$ and the primary voltage $V_1$ as comparative examples. FIGS. 5 and 6 show the waveforms of the case where the second end 222 of the secondary winding 22 is electrically connected to the shielding part 5, whereas FIGS. 27 and 28 show the waveforms of the case where they are not electrically connected.

The conditions under which the waveforms of FIGS. 5, 6, 27, and 28 were measured will be described. First, as the step-up transformer 2, one having an EE core was used. Further, the initial relative permeability of the core 23 (that is, the relative permeability in a state where no magnetic field is applied) was 2500, the gap was 0.3 mm, and the turn ratio $N_2/N_1$ was 23. The wire diameters of the primary winding 21 and the secondary winding 22 were 1 mm and 0.25 mm, respectively. The operating frequency was set to 0.7 MHz, and the peak-to-peak value of the primary current $I_1$ was set to 110 A.

As shown in FIGS. 5 and 6, when the second end 222 of the secondary winding 22 is electrically connected to the shielding part 5, a secondary voltage $V_2$ that is higher than the value obtained by multiplying the primary voltage $V_1$ by the turn ratio $N_2/N_1$ (=23) can be obtained. That is, sufficient resonance can be obtained.

On the other hand, as shown in FIGS. 27 and 28, when the second end 222 of the secondary winding 22 is not electrically connected to the shielding part 5, it can be seen that, as compared with FIGS. 5 and 6, the secondary voltage $V_2$ and the primary voltage $V_1$ are low. That is, it can be seen that sufficient resonance cannot be achieved.

Figure 7:
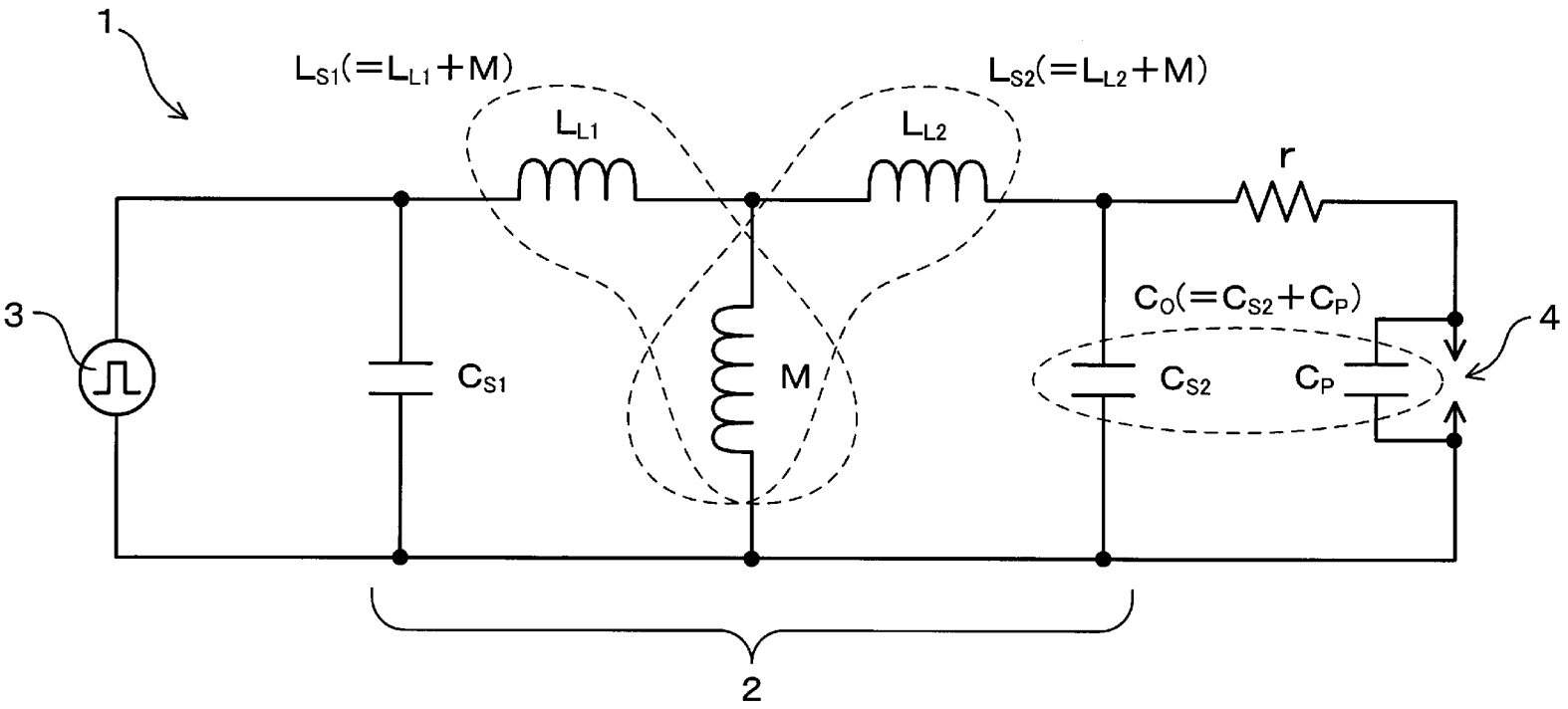
FIG. 7 is a simplified equivalent circuit diagram of the ignition device according to the first embodiment.

Next, FIG. 7 shows a simplified equivalent circuit of the ignition device 1. As shown in the figure, the step-up transformer 2 can be represented in a simplified manner by an equivalent circuit comprising a mutual inductance M, a leakage inductance $L_{L1}$ of the primary winding 21, and a leakage inductance $L_{L2}$ of the secondary winding 22. The self-inductance $L_{S1}$ of the primary winding 21 can be expressed as the sum of the leakage inductance $L_{L1}$ of the primary winding 21 and the mutual inductance M. That is, it can be expressed as follows:

$$L_{S1}=L_{L1}+M$$

Similarly, the self-inductance $L_{S2}$ of the secondary winding 22 can be expressed as the sum of the leakage inductance $L_{L2}$ of the secondary winding 22 and the mutual inductance M. That is, it can be expressed as follows. $L_{S2}=L_{L2}+M$ The stray capacitance $C_{S1}$ of the primary winding 21 is connected to the self-inductance $L_{S1}$ of the primary winding 21. In addition, the stray capacitance $C_{S2}$ of the secondary winding 22 is connected to the self-inductance $L_{S2}$ of the secondary winding 22. Further, the stray capacitance $C_P$ parasitic on the section between the secondary winding 22 to the spark plug 4 is connected to the leakage inductance $L_{L2}$ of the secondary winding 22.

Here, the resonance frequency of the self-inductance $L_{S2}$ of the secondary winding 22 and the stray capacitance $C_{S2}$ can be defined as a self-resonant frequency $f_s$. The self-resonant frequency f can be expressed by the following equation.

$$f_s=1/2\pi\sqrt{(L_{S2}C_{S2})} \quad (1)$$

If one tries to drive the step-up transformer 2 at a frequency higher than the self-resonant frequency $f_s$, the current would mainly flow to the stray capacitance $C_{S2}$. Thus, it is necessary to operate the step-up transformer 2 at a frequency lower than the self-resonant frequency $f_s$ (see FIG. 11).

As described above, the stray capacitance $C_{S2}$ parasitic on the second winding 22 itself and the stray capacitance $C_P$ parasitic on the section between the secondary winding 22 to the spark plug 4 are connected to the secondary winding 22. The sum of these stray capacitances is defined as the total stray capacitance $C_0$.

$$C_0=C_{S2}+C_P$$

The resonance frequency of the total stray capacitance $C_0$ and the leakage inductance $L_{L2}$ can be defined as a driving resonance frequency $f_0$. The driving resonance frequency $f_0$ can be expressed by the following equation.

$$f_0=1/2\pi\sqrt{(L_{L2}C_0)} \quad (2)$$

When making the spark plug 4 cause electric discharge, the secondary voltage $V_2$ resonates at this driving resonance frequency $f_0$.

Next, the relationship between the width of the gap 24 and the self-resonance frequency $f_s$ will be described. The narrower the width of the gap 24, the less the leakage of magnetic flux from the gap 24, and thus the leakage inductance $L_{L2}$ of the secondary winding 22 decreases and the mutual inductance M increases. As described above, the self-inductance $L_{S2}$ of the secondary winding 22 is expressed by the following equation.

$$L_{S2}=L_{L2}+M$$

The amount of increase of the mutual inductance M is larger than the amount of decrease of the leakage inductance $L_{L2}$. Therefore, the self-inductance $L_{S2}$ increases. Thus, it can be seen from the above equation (1) that when the gap 24 becomes narrower, the self-resonance frequency $f_s$ becomes lower.

On the contrary, when the gap 24 becomes wider, the leakage inductance 142 of the secondary winding 22 increases, and the self-inductance $L_{S2}$ decreases. Thus, it can be seen from the above equation (1) that the self-resonance frequency $f_s$ becomes higher.

Next, the relationship between the width of the gap 24 and the gain of the secondary voltage $V_2$ due to resonance (hereinafter also referred to as resonance gain η) will be described. The higher the resonance gain η is, the higher the obtained secondary voltage $V_2$. In addition, the resonance gain η can be expressed by the following equation, $$\eta=2\pi f_0 M/r \quad (3)$$

where M is the mutual inductance of the step-up transformer 2 and r is the electrical resistance from the secondary winding 22 to the spark plug 4.

When the gap 24 becomes narrower, the leakage inductance $L_{L2}$ of the secondary winding 22 decreases. Thus, it can be seen from the above equation (2) that the driving resonance frequency $f_0$ becomes higher. Therefore, from the above equation (3), it can be seen that the resonance gain η becomes higher.

Further, when the gap 24 becomes wider, the leakage inductance $L_{L2}$ of the secondary winding 22 increases. Thus, it can be seen from the above equation (2) that the driving resonance frequency $f_0$ becomes lower. Therefore, from the above equation (3), it can be seen that the resonance gain η becomes lower.

Next, the relationship between the initial relative permeability of the core 23 and the self-resonance frequency $f_s$ will be described. When the initial relative permeability becomes higher, the self-inductance $L_{S2}$ of the secondary winding 22 increases. Thus, it can be seen from the above equation (1) that the self-resonance frequency $f_s$ becomes lower.

Further, when the initial relative permeability of the core 23 becomes lower, the self-inductance $L_{S2}$ of the secondary winding 22 decreases. Thus, it can be seen from the above equation (1) that the self-resonance frequency f becomes higher.

Figure 8:
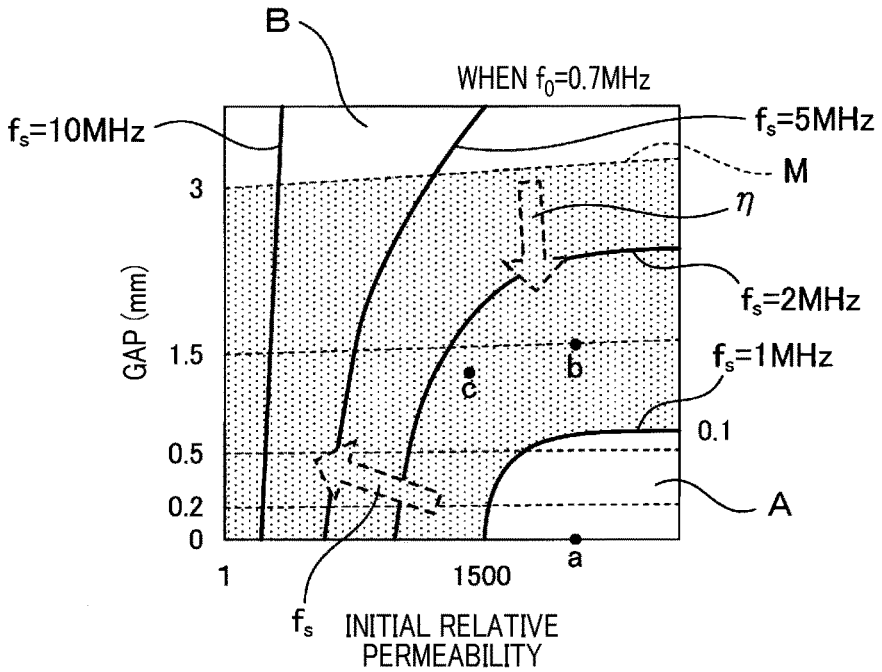
FIG. 8 is a graph showing the relationship of a gap and the initial relative permeability of a core with an area where the secondary voltage can effectively resonate according to the first embodiment.

Next, with reference to FIG. 8, desirable numerical ranges of the gap 24 of the core 23 and the initial relative magnetic permeability will be described. FIG. 8 is a graph showing the relationships of the width of the gap 24, the initial relative permeability of the core 23, and the area where the secondary voltage $V_2$ can sufficiently resonate. The hatched area indicates the area where the secondary voltage $V_2$ can sufficiently resonate. First, the conditions under which the graph of FIG. 8 was obtained will be described. A step-up transformer 2 having an EE core was used to acquire the graph of FIG. 8. The turn ratio $N_2/N_1$ was 41, and the wire diameters of the primary winding 21 and the secondary winding 22 were 1 mm and 0.25 mm, respectively. This step-up transformer 2 was operated at 0.7 MHz, which is the driving resonance frequency $f_0$ that gave the largest resonance gain η among those experimented. In addition, FIG. 8 shows lines where the self-resonant frequencies $f_s$ are 1, 2, 5, and 10 MHz, respectively.

In FIG. 8, there are two regions (that is, regions A and B) which cannot sufficiently resonate the secondary voltage $V_2$. In the region A, since $f_s<f_0$ is satisfied, it is a region where the secondary voltage $V_2$ cannot be sufficiently resonated. In the region B, since the resonance gain η<1 is satisfied, it is a region where a high secondary voltage $V_2$ cannot be obtained. As described above, when the gap 24 becomes wider, the resonance gain becomes smaller. Therefore, it can be seen that enlarging the gap 24 too much results in falling within the region B where η<1 is satisfied. Further, as described above, when the initial relative permeability of the core 23 becomes higher, the self-resonance frequency $f_s$ becomes smaller. Thus, it can be seen that when the initial relative permeability is too high, $f_s<f_0$ is satisfied, resulting in falling within the region A where the secondary voltage $V_2$ cannot be sufficiently resonated. Therefore, it is preferable to provide the gap 24 and the initial relative permeability such that the hatched region in FIG. 8 can be achieved.

Note that the horizontal lines in FIG. 8 indicate lines where the mutual inductance M is the same. Even if the width of the gap is the same, the higher the initial relative permeability, the higher the synthetic permeability, and higher the mutual inductance M. Therefore, the horizontal axis of FIG. 8 is a straight line which rises as it gets to the right.

Figure 9:
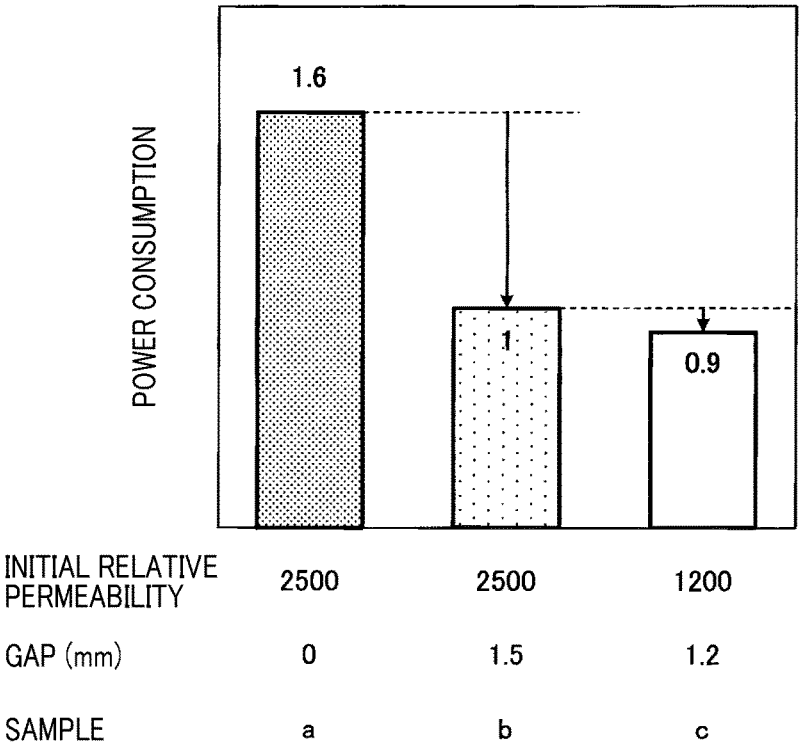
FIG. 9 is a graph showing the relationship of the gap and the initial relative permeability of the core with power consumption according to the first embodiment.

Next, the relationship of the gap 24 of the core 23 and the initial relative permeability with the power consumption of the step-up transformer 2 is shown referring to FIG. 9. Three samples were prepared to make the graph of FIG. 9. The sample a is a sample with an initial relative permeability of 2500 and has no gap 24. The sample b is a sample with an initial relative permeability of 2500 and has a gap 24 of 1.5 mm. The sample c is a sample with an initial relative permeability of 1200 and has a gap 24 of 1.2 mm. Where the samples are located in FIG. 8 are shown therein.

Since $f_s<f_0$ is satisfied for the sample a, the secondary voltage $V_2$ cannot be sufficiently resonated. Therefore, if one intends to forcibly make the spark plug 4 cause discharge, high power needs to be supplied from the oscillator 3 to the step-up transformer 2, as shown in FIG. 9. As for the sample b, since the initial relative permeability and the gap 24 is determined so that the secondary voltage $V_2$ can sufficiently resonate (see FIG. 8), the spark plug 4 can be discharged even if the power sent from the oscillator 3 is less than that of the sample a. Further, regarding the sample c, since it has a gap 24 that is narrower than that of the sample b and the resonance gain η is higher, the spark plug 4 can be discharged even if the power consumption is further reduced.

Next, the relationship of the width of the gap 24, the self-resonance frequency $f_s$, and the resonance η gain will be described with reference to FIG. 10. First, the conditions under which the graph of FIG. 10 was obtained will be described. A step-up transformer 2 having an EE core was used to acquire the graph of FIG. 10. Further, the initial relative permeability of the core 23 was set to 2500, and the turn ratio $N_2/N_1$ was set to 23. The wire diameters of the primary winding 21 and the secondary winding 22 were 1 mm and 0.25 mm, respectively. In addition, the conditions of the gap 23 were varied, and the self-resonance frequency $f_s$ and the resonance gain η were measured. The self-resonance frequency $f_s$ was measured using ZA5405 manufactured by NF Corporation.

As described above, when the gap 24 becomes narrower, the self-resonance frequency $f_s$ becomes smaller. As can be seen from FIG. 10, when the gap 24 is narrower than 0.01 mm, the self-resonance frequency $f_s$ becomes 1 MHz or less, and $f_s<f_0$ is satisfied. Therefore, the secondary voltage $V_2$ cannot sufficiently resonate. Thus, it is preferable that the gap 24 is 0.01 mm or greater.

Further, as described above, when the gap 24 becomes wider, the resonance gain becomes smaller. As can be seen from FIG. 10, when the gap 24 becomes wider than 3 mm, the resonance gain becomes η<1, and the secondary voltage $V_2$ cannot resonate sufficiently. Therefore, it is preferable that the gap 24 is 3 mm or less.

Next, the configuration of the oscillator 3 will be described. As shown in FIG. 2, the oscillator 3 includes a pulse generator 31, a drive circuit 32, a half bridge circuit 33, and a pair of capacitors 34 and 35. The half bridge circuit 33 comprises a pair of switching elements 331 and 332 connected in series with each other. One end 211 of the primary winding 21 of the step-up transformer 2 is connected between the pair of switching elements 331 and 332. In this embodiment, MOSFETs are used as the switching elements 331 and 332.

The other end 212 of the primary winding 21 is connected between the pair of capacitors 34 and 35. Assuming that the potential of the power supply 38 is E, the potential of the connection point 39, that is, the potential of the other end 212 of the primary winding 21 is E/2. The oscillator 3 is configured to alternately turn on/off the pair of switching elements 331 and 332, thereby generating a pulsed output voltage shown in FIG. 12 and applying it to the primary winding 21. This output voltage has a waveform in which the potential on the one end 211 side changes alternately to +E/2 and −E/2 from the reference, i.e., the other end 212 of the primary winding 21. Further, in the present embodiment, the frequency $f_m$ of the oscillator 3 is set to 0.1-20 MHz. The oscillator 3 is configured such that its frequency $f_m$ satisfies the following equation.

$$0.95f_0<f_m<1.05f_0$$

Next, the functions and effects of this embodiment will be described. As shown in FIG. 1, in this embodiment, the second end 222 of the secondary winding 22 is electrically connected to the shielding part 5.

Therefore, it is possible to make the potential of the second end 222 of the secondary winding 22 and the potential of the shielding part 5 the same. Thus, it is possible to suppress the potential of the shielding part 5 oscillating with respect to the reference potential of the secondary winding 22, that is, the potential of the second end 222. Thus, it is possible to make the phases of induced voltage V generated in the shielding part 5 (see FIG. 4) and the secondary voltage $V_2$ match. Accordingly, the phases of the induced magnetic flux $\varphi_t$ returning to the core 23 from the shielding part 5 and the secondary voltage $V_2$ can be matched with each other, which allows the secondary voltage $V_2$ to resonate more effectively. Therefore, a high secondary voltage $V_2$ can be obtained, and the spark plug 4 can be discharged easier.

As shown in FIGS. 2 and 3, the ignition device 1 of this embodiment comprises the case 50 for accommodating the step-up transformer 2. The case 50 constitutes the shielding part 5.

Therefore, it is possible to integrate the case 50 and the shielding portion 5 into one component, and the number of parts can be reduced. This allows the manufacturing cost of the ignition device 1 to be reduced.

Further, as shown in FIG. 1, in this embodiment, the second end 222 of the secondary winding 22 and the shielding part 5 are grounded.

Therefore, when the shielding portion 5 is charged, the charge can be promptly transferred to the ground. In addition, grounding the shielding part 5 enhances shielding of radiation noise emitted from the step-up transformer 2.

Further, in this embodiment, the width of the gap 24 and the initial relative permeability of the core 23 are determined so that the plot falls within the hatched region of the graph shown in FIG. 8. That is, the width of the gap 24 and the initial relative permeability are determined so as to satisfy the following equations (4) and (5). Therefore, the step-up transformer 2 can be oscillated more efficiently.

$$\eta>1 \tag{4}$$

$$f_s>f_0 \tag{5}$$

Further, as shown in FIG. 2, the oscillator 3 includes at least one half-bridge circuit 33. One end 211 of the primary winding 21 is connected between the two switching elements 331 and 332 constituting the half bridge circuit 33. By tuning the switching elements 331 and 332 on and off, the potential of the one end 211 side is changed alternately between positive and negative with reference to the potential of the other end 212 of the primary winding 21 (see FIG. 12).

In this case, it is possible to efficiently apply positive/negative alternating voltage to the step-up transformer 2 with a small number of switching elements.

Further, in the present embodiment, the frequency $f_m$ of the oscillator 3 is set to 0.1-20 MHz. When the frequency $f_m$ of the oscillator 3 is less than 0.1 MHz, it becomes more difficult for the spark plug 4 to generate streamer discharge. On the other hand, when the frequency exceeds 20 MHz, the driving resonance frequency $f_0$ tends to be closer to the self-resonance frequency $f_s$, and oscillation is suppressed.

In addition, the oscillator 3 of this embodiment is configured such that its frequency $f_m$ satisfies the following equation.

$$0.95f_0<f_m<1.05f_0$$

Therefore, it is possible to make the frequency $f_m$ of the oscillator 3 and the driving resonance frequency $f_0$ substantially the same, and the secondary voltage $V_2$ can be effectively oscillated. Thus, the spark plug 4 can be discharged more effectively.

Note that the frequency $f_m$ of the oscillator 3 may be intentionally shifted from the above range. This makes it possible to generate mainly the desired kind of discharge among a plurality of kinds of discharges such as streamer discharge, corona discharge, spark discharge, glow discharge, and so on.

As described above, according to the present embodiment, an ignition device that can more efficiently resonate the secondary voltage of the step-up transformer and easily cause the ignition plug to generate electrical discharge can be provided.

In this embodiment, as shown in FIG. 2, only one half bridge circuit 331 is provided. However, the present invention is not limited to this, and instead a plurality of half bridge circuits 331 may be provided. Further, although in this embodiment a creeping discharge plug is used as the ignition plug 4, another ignition plug 4 may be used.

Further, although in this embodiment the second end 222 of the secondary winding 22 and the shielding part 5 are grounded, the present invention is not limited to this. That is, they may not be grounded and may be instead connected to the reference electrode 49 of the spark plug 49 (see FIG. 2).

In the embodiments described below, among the reference numbers used in their drawings, the same reference numbers as those used in the first embodiment denote components or the like that are similar to those of the first embodiment unless otherwise noted.

Second Embodiment

Figure 13:
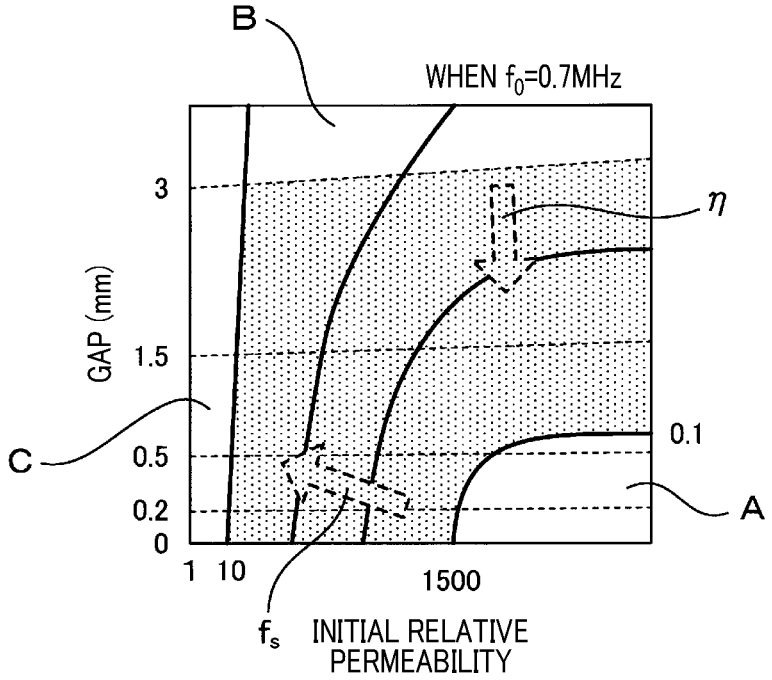
FIG. 13 is a graph showing the relationship of the gap and the initial relative permeability of the core with an area in which the secondary voltage can further effectively resonate according to a second embodiment.

This embodiment is an example where the numerical range of the initial relative permeability is changed. In this embodiment, the initial relative magnetic permeability of the core 23 is set to 10-1500. FIG. 13 shows the relationship of the gap 24, the initial relative permeability, and a region in which the spark plug 4 can generate electric discharge with a further reduced primary current $I_1$. FIG. 13 was prepared using the same step-up transformer 2 as that used to acquire the graph of FIG. 8.

As shown in FIG. 13, when the initial relative permeability of the core 13 is less than 10, unless a high primary current $I_1$ is supplied from the oscillator 3 to the primary winding 21, the plot falls within the C region in which the spark plug 4 cannot generate discharge. That is, when the initial relative permeability becomes smaller, the self-inductance $L_{S2}$ of the secondary winding 22 decreases. Thus, when the initial relative permeability is too small, the self-inductance $L_{S2}$ of the secondary winding 22 becomes too small, and it becomes difficult to obtain a sufficiently high secondary voltage $V_2$. Thus, unless a high primary current $I_1$ is supplied from the oscillator 3 to the primary winding 21, the spark plug 4 cannot be ignited.

When the initial relative permeability is less than 10, it is necessary to set the peak-to-peak value of the current supplied from the oscillator 3 to the primary winding 21 to 200 A or greater. Therefore, using switching elements 331 and 332 (see FIG. 2) that can supply a high current will be required, and the manufacturing cost of the oscillator 3 tends to increase. On the other hand, if the initial relative permeability is set to 10 or greater, the peak-to-peak value of the primary current $I_1$ can be less than 200 A. Therefore, commercially available switching elements 331 and 332 can be used, and the manufacturing cost of the oscillator 3 can be reduced.

Figure 10:
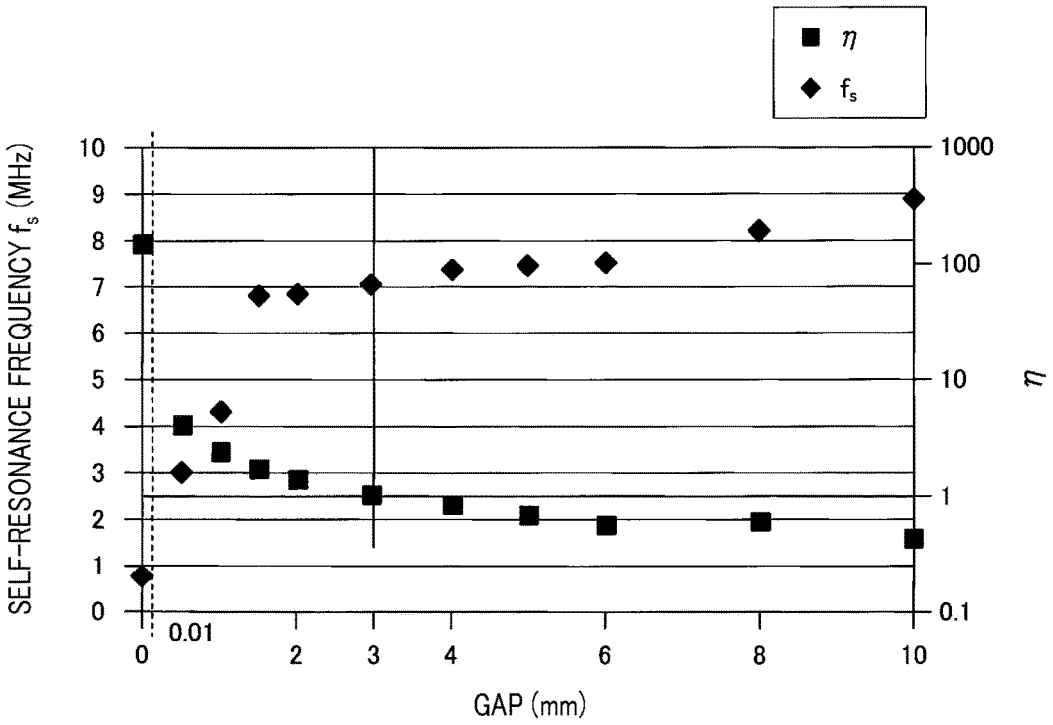
FIG. 10 is a graph showing the relationship of the gap of the core, the self-resonance frequency $f_s$, and the resonance gain according to the first embodiment.
Figure 11:
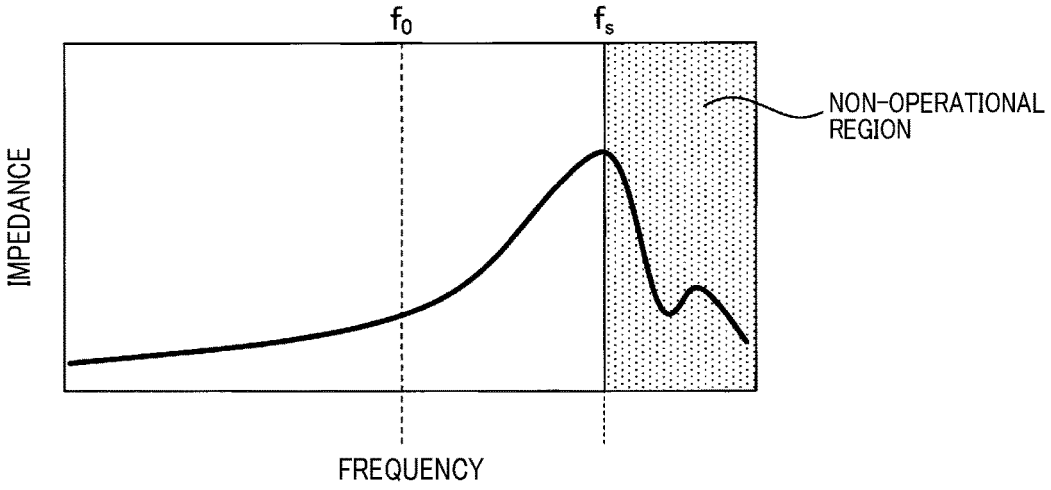
FIG. 11 is a graph showing the relationship between the frequency of the step-up transformer and the impedance according to the first embodiment.
Figure 12:
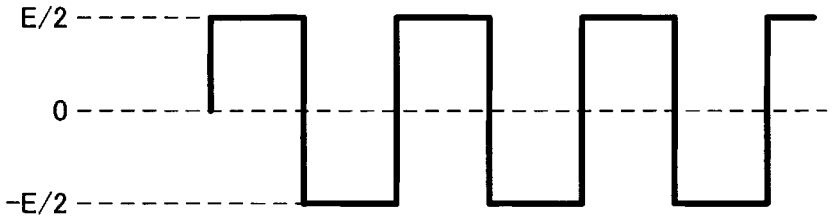
FIG. 12 is a waveform graph of the output voltage of the oscillator according to the first embodiment.

As with the first embodiment, in this embodiment, the gap 24 has a width of 0.01 to 3 mm (see FIG. 10). Therefore, the self-resonance frequency $f_s$ can be sufficiently higher than the drive resonance frequency $f_0$. Further, the resonance efficiency $\eta$ can be 1 or greater.

As explained above, by designing the gap 24 to be 0.1 to 3 mm and the initial relative permeability to be 10 to 1500, $f_s>f_0$ and $\eta>1$ can be satisfied, and also the primary current $I_1$ supplied from the oscillator 3 to the primary winding 21 can be reduced.

Further, since the peak-to-peak value of the primary current $I_1$ is 200 A or less in this embodiment, there is no need to use switching elements 331 and 332 that can supply a particularly high current, and the manufacturing cost of the oscillator 3 can be reduced.

In addition, this embodiment has a similar configuration, and similar functions and effects as those of the first embodiment.

Note that although a step-up transformer 2 having an EE core was used to acquire the graph of FIG. 13 as in the first embodiment, similar functions and effects can be obtained even when an EI core is used.

Third Embodiment

Figure 14:
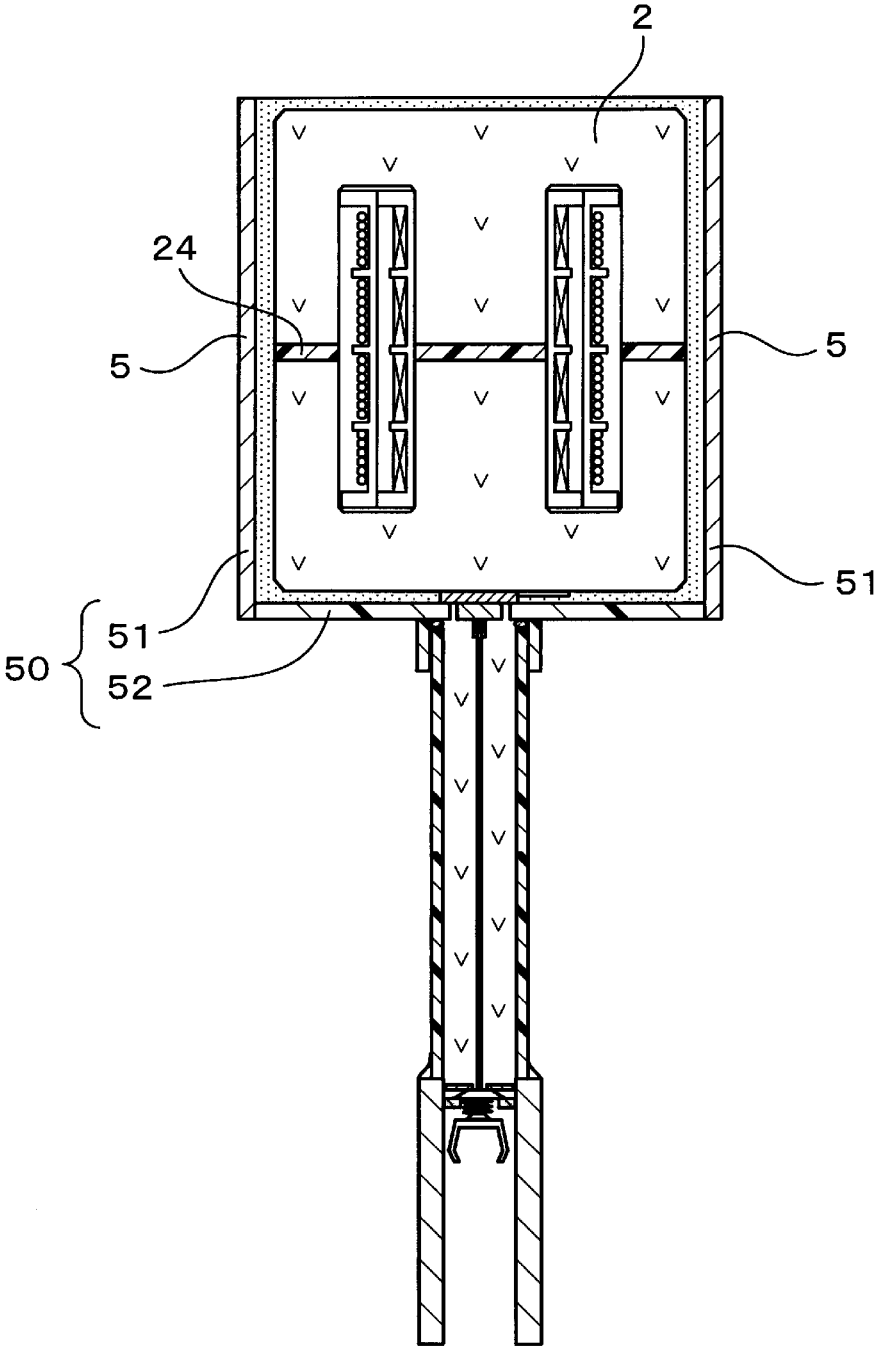
FIG. 14 is a cross-sectional view of a step-up transformer and a case according to a third embodiment.

This embodiment is an example in which the configuration of the case 50 is changed. As shown in FIG. 14, the case 50 of this embodiment includes a wall part 51 and a bottom part 52 as in the first embodiment. The wall part 51 is made of metal and the bottom part 52 is made of insulating resin. The wall part 51 also serves as the shielding part 5. As described above, in this embodiment, a part of the case 50 (that is, the wall part 51) constitutes the shielding part 5.

Other than the above, this embodiment has a similar configuration, and similar functions and effects as those of the first embodiment.

Fourth Embodiment

Figure 15:
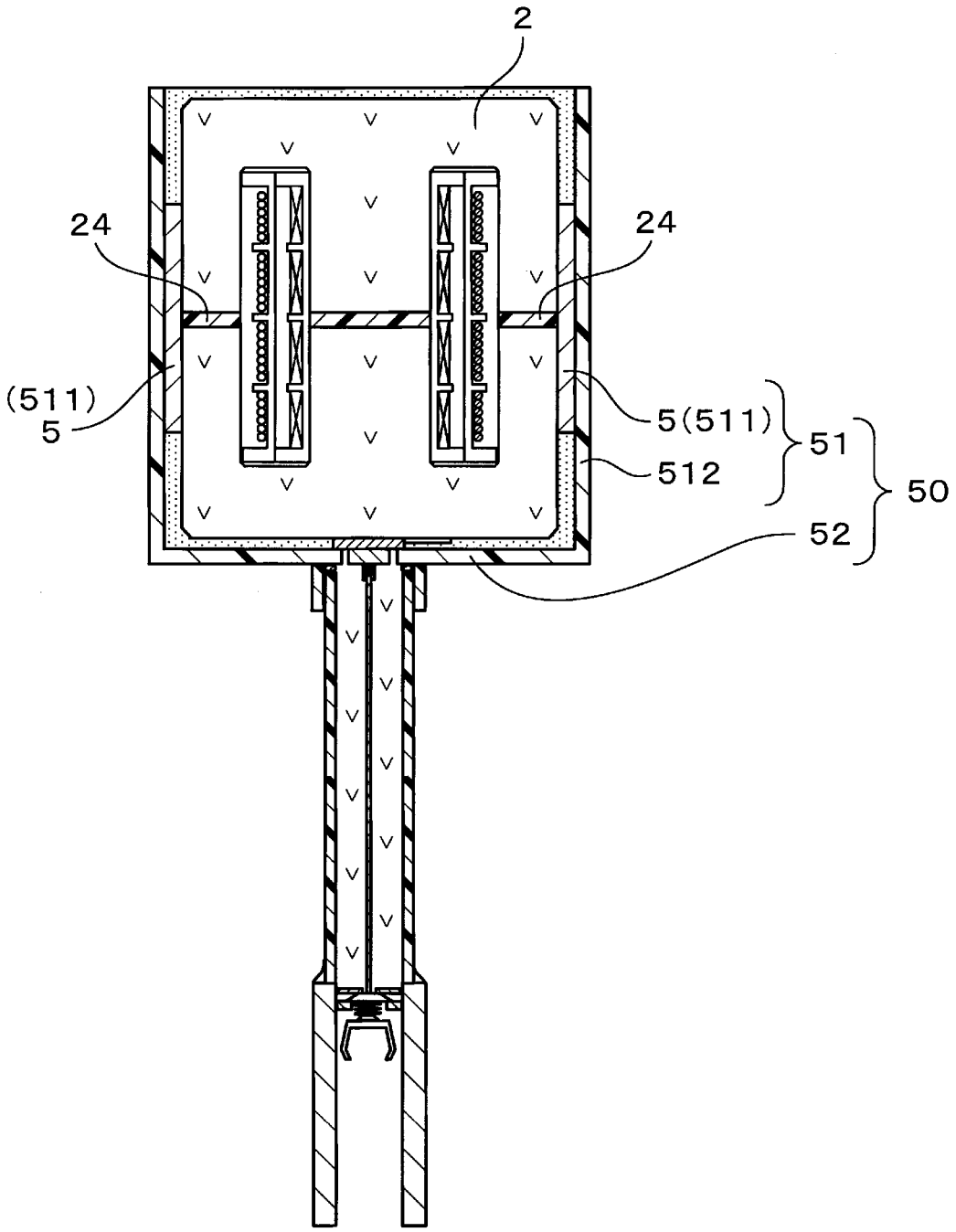
FIG. 15 is a cross-sectional view of the step-up transformer and the case according to a fourth embodiment.

This embodiment is an example in which the configuration of the case 50 is changed. As shown in FIG. 15, the case 50 of this embodiment includes a wall part 51 and a bottom part 52 as in the first embodiment. The wall part 51 is composed of a metal first portion 511 and a resin second portion 512. The first portion 511 constitutes the shielding part 5. As described above, in this embodiment, a part of the case 50 (that is, the first portion 511) constitutes the shielding part 5.

Other than the above, this embodiment has a similar configuration, and similar functions and effects as those of the first embodiment.

Fifth Embodiment

Figure 16:
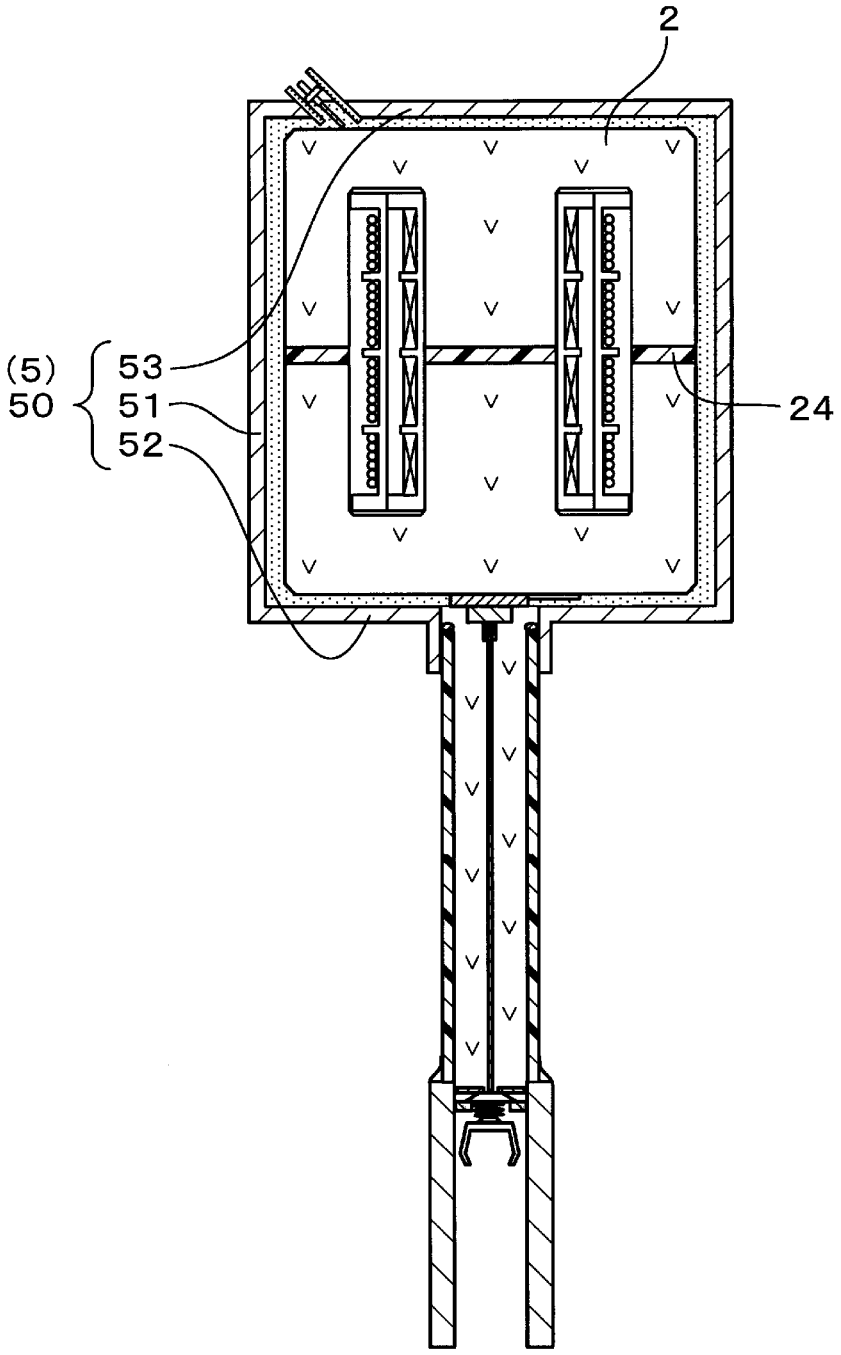
FIG. 16 is a cross-sectional view of the step-up transformer and the case according to a fifth embodiment.

This embodiment is an example in which the configuration of the case 50 is changed. As shown in FIG. 16, the case 50 of this embodiment includes a wall part 51, a bottom part 52, and a top plate 53. The wall part 51, the bottom part 52, and the top plate 53 are all made of metal. The case 50 constitutes the shielding part 5.

Other than the above, this embodiment has a similar configuration, and similar functions and effects as those of the first embodiment.

Sixth Embodiment

Figure 17:
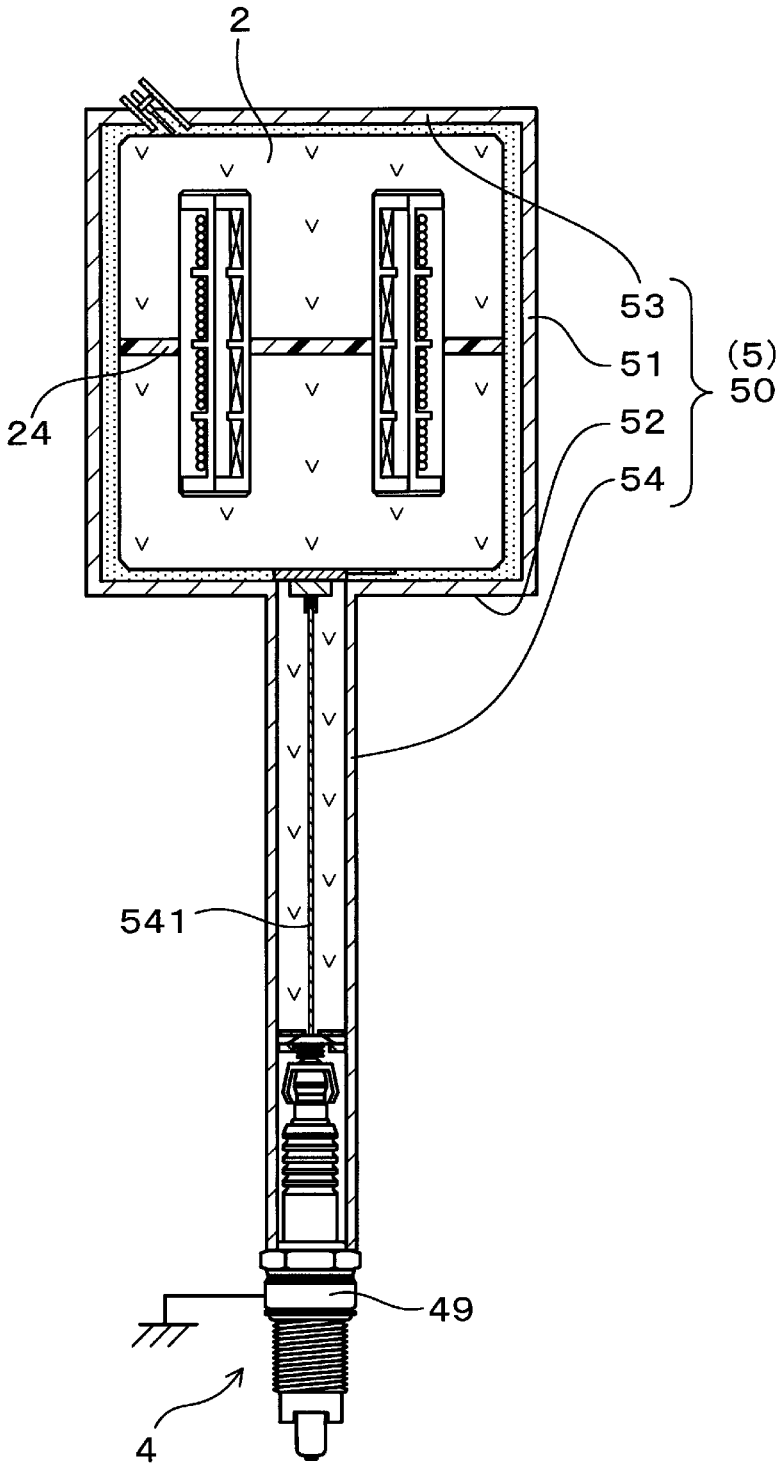
FIG. 17 is a cross-sectional view of the step-up transformer, the case, and an ignition plug according to a sixth embodiment.

This embodiment is an example in which the configuration of the case 50 is changed. As shown in FIG. 17, the case 50 of this embodiment includes a wall part 51, a bottom part 52, a top plate 53, and a tubular part 54 extending from the bottom part 52. The ignition plug 4 is attached to the leading end of the tubular part 54. A wiring 541 connecting the secondary winding 22 and the spark plug 4 is provided within the tubular part 54.

The wall part 51, the bottom part 52, the top plate 53, and the tubular part 54 are all made of metal. Further, the tubular part 54 is connected to the reference electrode 49 of the spark plug 4. The reference electrode 49 is connected to an internal combustion engine (not shown), and this internal combustion engine is grounded. In this embodiment, the case 50 is grounded via the internal combustion engine by connecting the tubular part 54 to the reference electrode 49.

With the above configuration, there is no need to provide a wire or the like for grounding the case 50, and the configuration of the ignition device 1 can be simplified. This allows the manufacturing cost of the ignition device 1 to be reduced.

Other than the above, this embodiment has a similar configuration, and similar functions and effects as those of the first embodiment.

Seventh Embodiment

Figure 18:
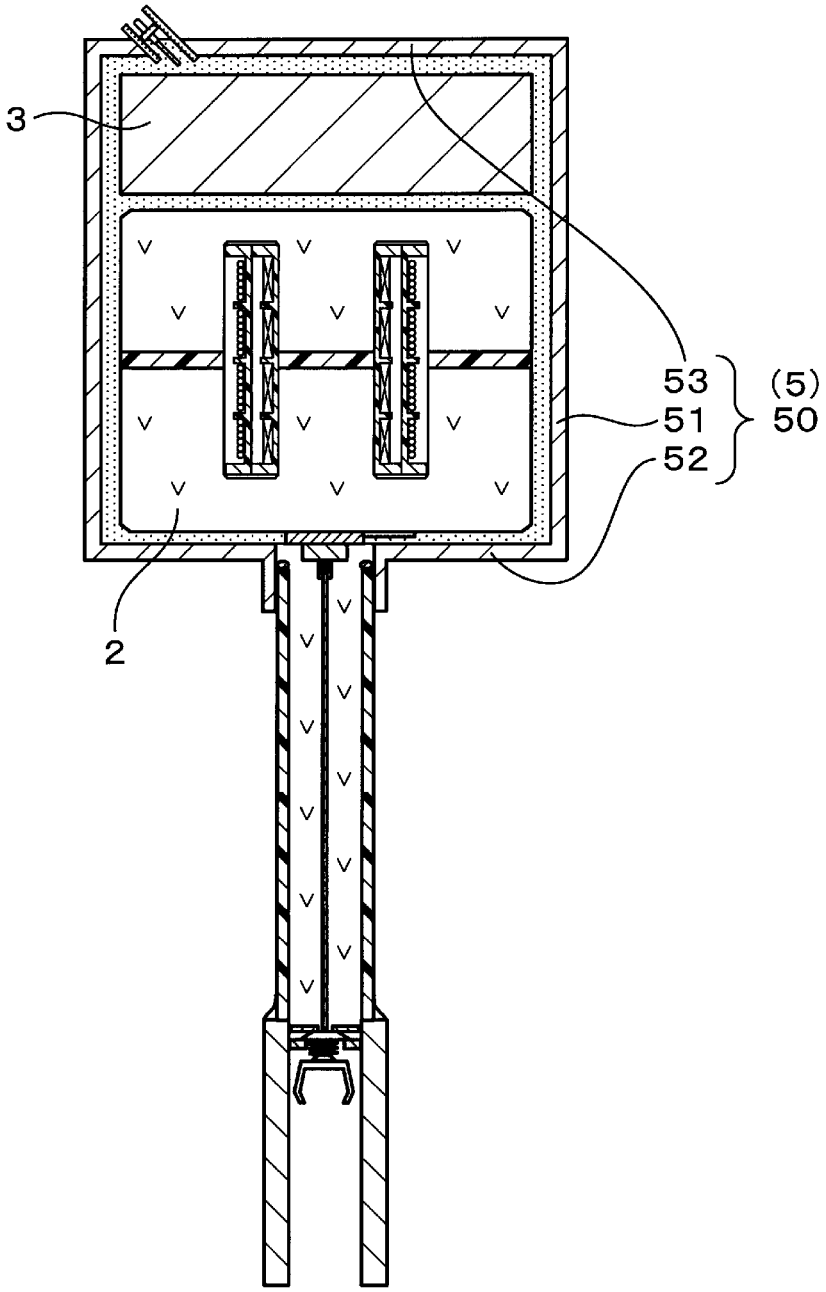
FIG. 18 is a cross-sectional view of the step-up transformer and the case according to a seventh embodiment.

This embodiment is an example in which the configuration of the case 50 is changed. As shown in FIG. 18, in this embodiment, the case 50 contains the step-up transformer 2 and the oscillator 3. The case 50 includes a wall part 51, a bottom part 52, and a top plate 53. The wall part 51, the bottom part 52, and the top plate 53 are all made of metal. The case 50 constitutes the shielding part 5.

With the above configuration, the oscillator 3 and the step-up transformer 2 can be integrated, and the number of parts can be reduced.

Other than the above, this embodiment has a similar configuration, and similar functions and effects as those of the first embodiment.

Eighth Embodiment

Figure 19:
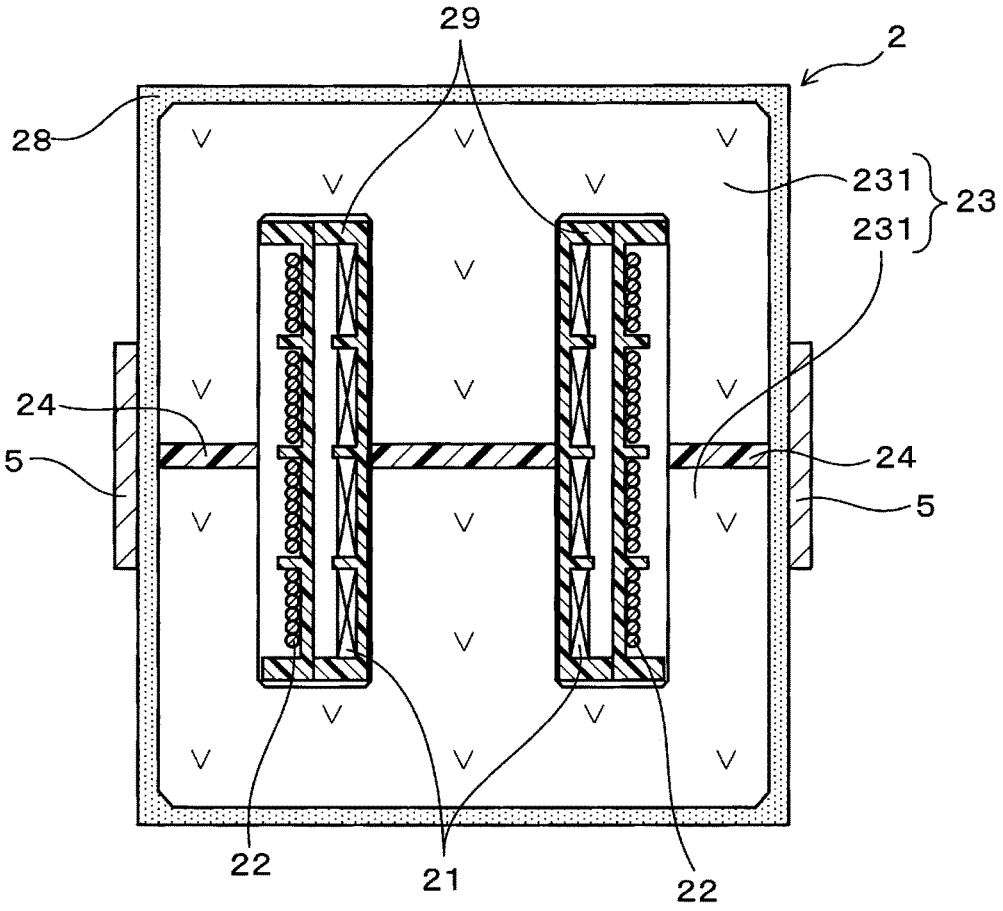
FIG. 19 is a cross-sectional view of the step-up transformer and a shielding part according to an eighth embodiment.

In this embodiment, as shown in FIG. 19, the case 50 is not provided. As shown in FIG. 19, the step-up transformer 2 of this embodiment includes two core pieces 231, a bobbin 29, a primary winding 21, and a secondary winding 22 as in the first embodiment. These components are sealed with a sealing member 28 to form a single component. In addition, an annular shielding part 5 made of metal is provided at a position adjacent to the gap 24.

Other than the above, this embodiment has a similar configuration as that of the first embodiment.

Ninth Embodiment

Figure 20:
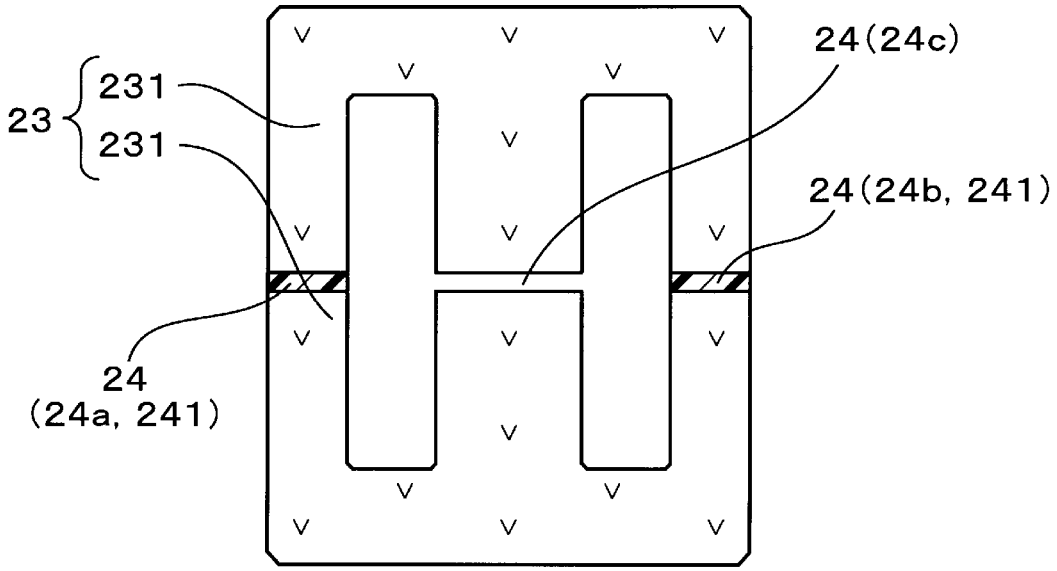
FIG. 20 is a cross-sectional view of a core according to a ninth embodiment.

This embodiment is an example in which the configuration of the gap 24 is changed. As shown in FIG. 20, in this embodiment, by two E-shaped core pieces 231 constitute the core 23 is as in the first embodiment. Three gaps 24 (24*a*, 24*b*, 24*c*) are formed between the core pieces 231. Among the three gaps 24, the first gap 24*a* and the second gap 24*b* are provided with a gap forming member 241. The third gap 24*c* is not provided with the gap forming member 241. The third gap 24*c* is an air gap.

Other than the above, this embodiment has a similar configuration, and similar functions and effects as those of the first embodiment.

Tenth Embodiment

Figure 21:
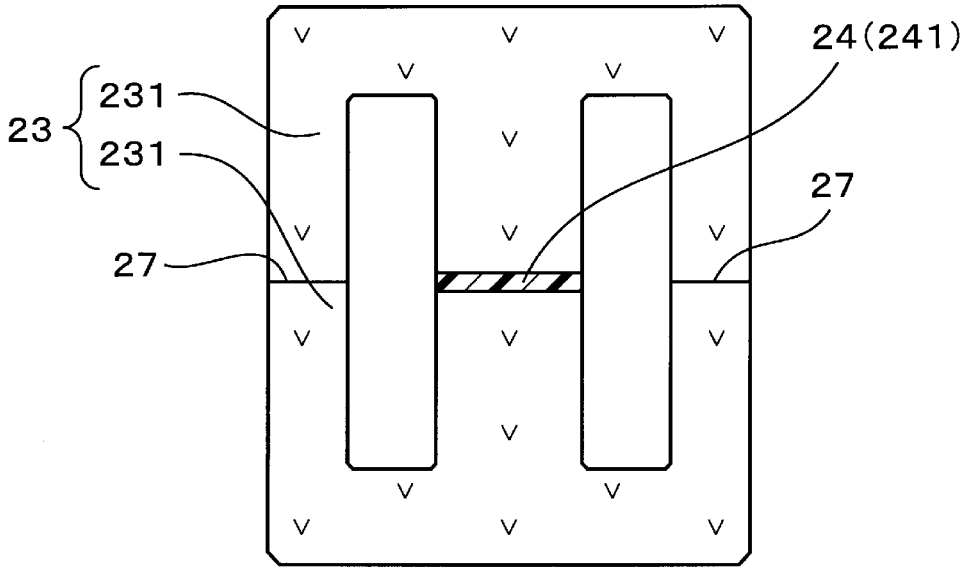
FIG. 21 is a cross-sectional view of the core according to a tenth embodiment.

This embodiment is an example in which the configuration of the gap 24 is changed. As shown in FIG. 21, in this embodiment, the core 23 is constituted by two E-shaped core pieces 231 as in the first embodiment. These core pieces 231 are in contact with each other at two contact parts 27. Further, a single gap 24 is formed between the two core pieces 231. The gap 24 is provided with a gap forming member 241 such as resin.

Other than the above, this embodiment has a similar configuration, and similar functions and effects as those of the first embodiment.

Eleventh Embodiment

Figure 22:
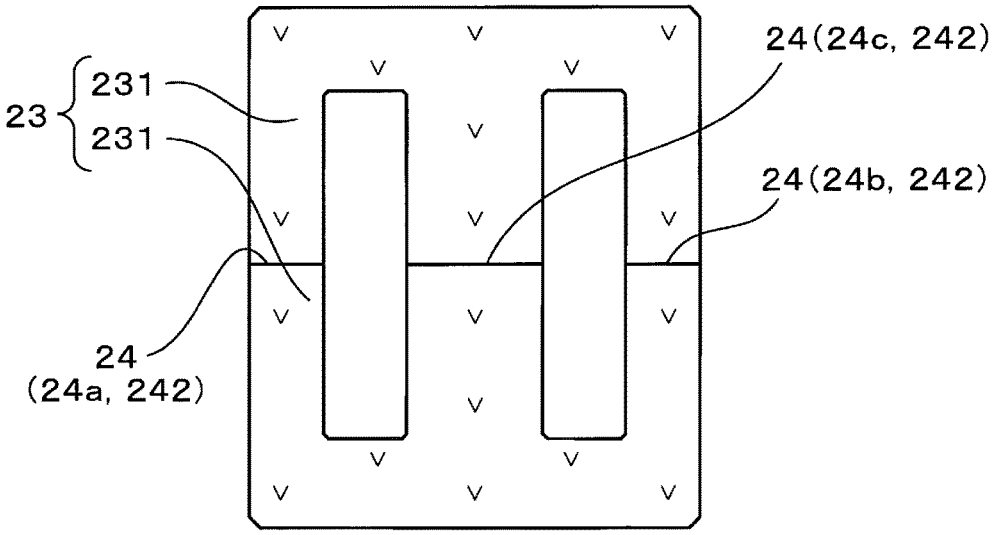
FIG. 22 is a cross-sectional view of the core according to an eleventh embodiment.

This embodiment is an example in which the configuration of the gap 24 is changed. As shown in FIG. 22, in this embodiment, the core 23 is constituted by two E-shaped core pieces 231 as in the first embodiment. Three gaps 24 (24*a*, 24*b*, 24*c*) are formed between the core pieces 231. In each gap 24, a thin film layer 242 is interposed. The thin film layer 242 is made of, for example, a metal plating layer, a thin film of resin or the like, or a coating layer of resin or the like.

Other than the above, this embodiment has a similar configuration, and similar functions and effects as those of the first embodiment.

Twelfth Embodiment

Figure 23:
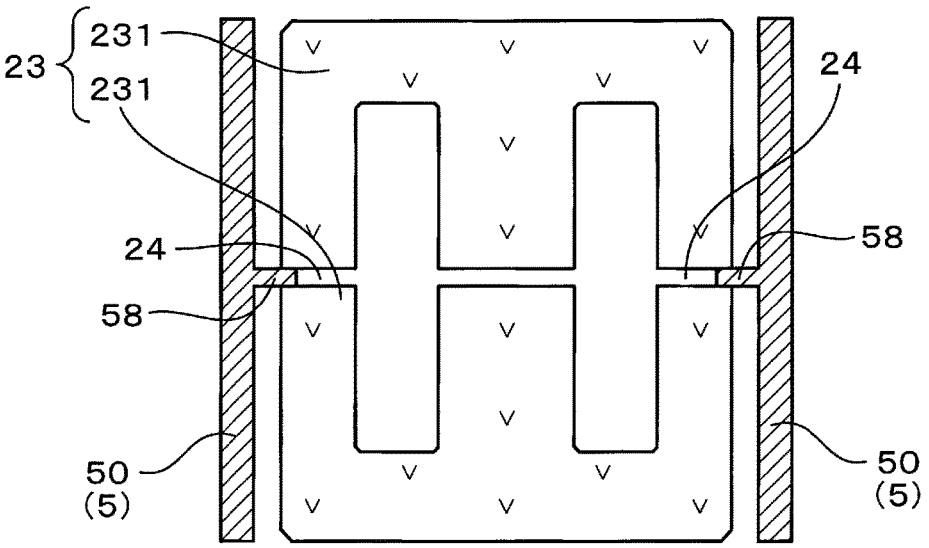
FIG. 23 is a cross-sectional view of the core and the case according to a twelfth embodiment.

This embodiment is an example in which the configuration of the case 50 is changed. As shown in FIG. 23, in this embodiment, the case 50 comprises a protruded part 58. The protruded part 58 is clamped by the two core pieces 231. The gap 24 (i.e., air gap) between the two core pieces 231 is thereby formed.

Other than the above, this embodiment has a similar configuration, and similar functions and effects as those of the first embodiment.

Thirteenth Embodiment

Figure 24:
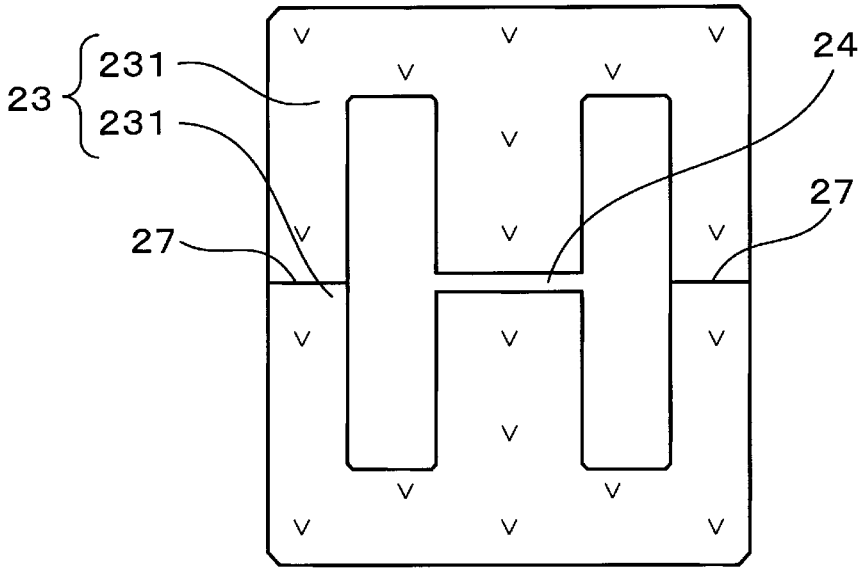
FIG. 24 is a cross-sectional view of the core according to a thirteenth embodiment.

This embodiment is an example in which the configuration of the gap 24 is changed. As shown in FIG. 24, in this embodiment, the core 23 is constituted by two E-shaped core pieces 231 as in the first embodiment. These core pieces 231 are in contact with each other at two contact parts 27. Further, a single gap 24 is formed between the two core pieces 231. The gap 24 is an air gap.

Other than the above, this embodiment has a similar configuration, and similar functions and effects as those of the first embodiment.

Fourteenth Embodiment

Figure 25:
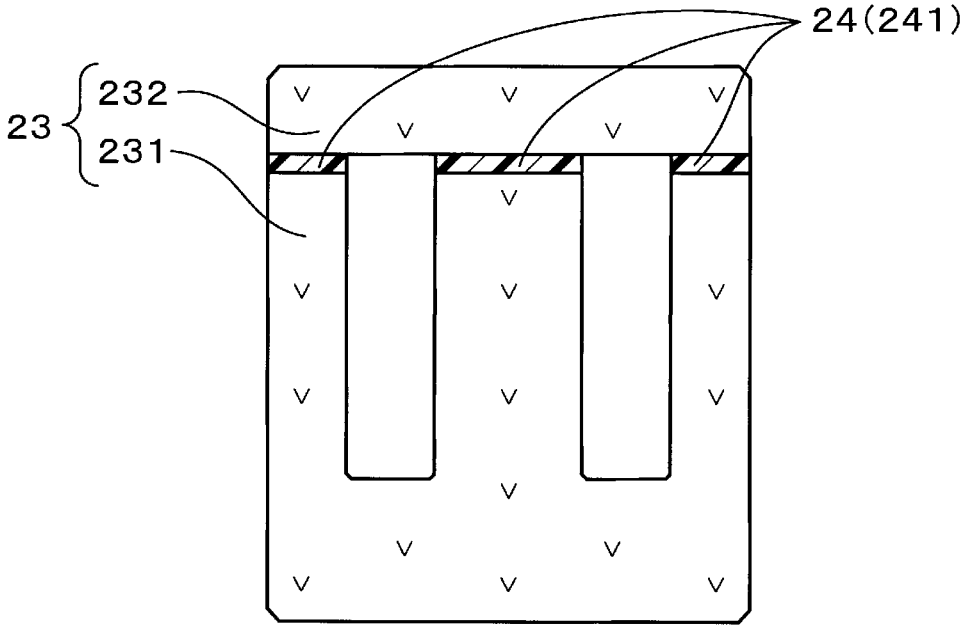
FIG. 25 is a cross-sectional view of the core according to a fourteenth embodiment.

This embodiment is an example in which the shape of the core 23 is changed. As shown in FIG. 25, the core 23 of this embodiment is an EI core formed by combining an E-shaped core piece 231 and an I-shaped core piece 232. Between the core pieces 231 and 232, a gap forming member 241 is interposed. The gap 24 is thereby formed between the two core pieces 231 and 232.

Other than the above, this embodiment has a similar configuration, and similar functions and effects as those of the first embodiment.

Fifteenth Embodiment

Figure 26:
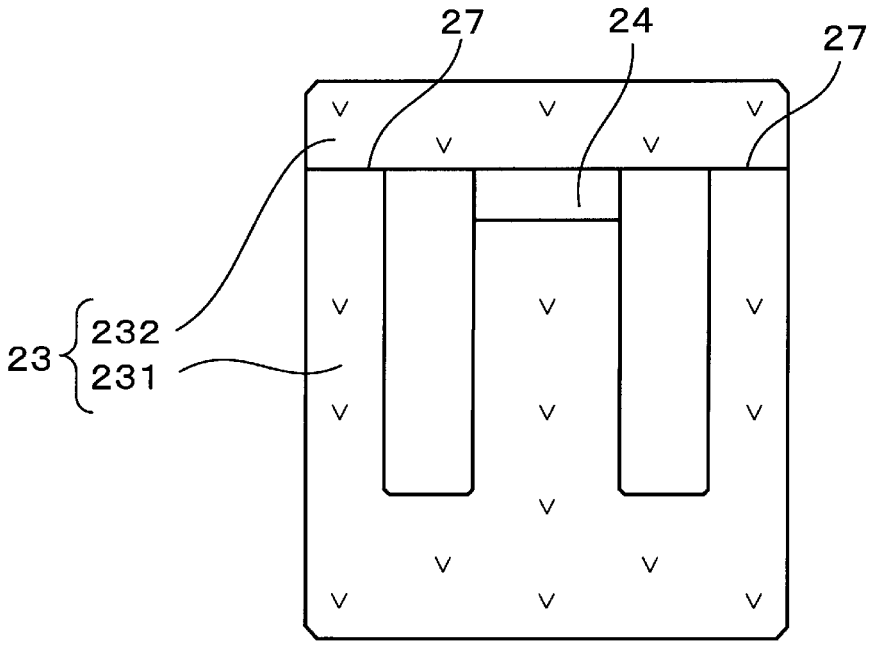
FIG. 26 is a cross-sectional view of the core according to a fifteenth embodiment.

This embodiment is an example in which the configurations of the core 23 and the gap 24 are changed. As shown in FIG. 26, in this embodiment, the core 23 of this embodiment is formed by combining an E-shaped core piece 231 and an I-shaped core piece 232. These core pieces 231 and 232 are in contact with each other at two contact parts 27. Further, a gap 24 is formed between the two core pieces 231 and 232. The gap 24 is an air gap.

Other than the above, this embodiment has a similar configuration, and similar functions and effects as those of the first embodiment.

Although the present disclosure is described based on embodiments, it should be understood that the present disclosure is not limited to the embodiments and structures. The present disclosure encompasses various modifications and variations within the scope of equivalence. In addition, the scope of the present disclosure and the spirit include other combinations and embodiments, which may include only one component, one component or more and one component or less.

What is claimed is:

1. An ignition device comprising:

a step-up transformer including a primary winding, a secondary winding, and a core made of a soft magnetic material having a gap;

an oscillator connected to the primary winding;

an ignition plug connected to a first end of the secondary winding; and a shielding part made of a conductive material and shielding magnetic flux leaking from the gap, wherein the ignition device is configured to cause the ignition plug to generate discharge by applying an alternating voltage to the primary winding by the oscillator, and causes a secondary voltage generated in the secondary winding to resonate, and a second end of the secondary winding, which is the end opposite to the first end, is electrically connected to the shielding part.

2. The ignition device according to claim 1, comprising a case for housing the step-up transformer, wherein at a least a part of the case constitutes the shielding part.

3. The ignition device according to claim 1, wherein the second end of the secondary winding and the shielding part are grounded.

4. The ignition device according to claim 1, wherein a magnetic permeability of the core and a width of the gap of the core are determined so as to satisfy the following equations, where η is a gain of the secondary voltage due to resonance, $f_0$ is a driving resonance frequency which is a resonance frequency of the secondary voltage when the ignition plug is generating the discharge, and $f_s$ is a self-resonance frequency of the secondary winding.

$$\eta>1$$

$$f_s>f_0$$

5. The ignition device according to claim 1, wherein a peak-to-peak value of a current supplied from the oscillator to the primary winding is set to 200 A or less.

6. The ignition device according to claim 1, wherein the core is an EE core or an EI core with an initial relative permeability of 10 to 1500, and the width of the gap is 0.01 to 3 mm.

7. The ignition device according to claim 1, wherein the oscillator includes at least one half-bridge circuit, one end of the primary winding is connected between two switching elements constituting the half-bridge circuit, and the switching elements are turned on and off so that a potential on the side of the one end is alternately changed between positive and negative with reference to a potential at the other end of the primary winding.

8. The ignition device according to claim 1, wherein a frequency of the oscillator is 0.1 to 20 MHz.

9. The ignition device according to claim 1, configured so as to satisfy the following equation, where $f_m$ is a frequency of the oscillator, and $f_0$ is a driving resonance frequency which is a resonance frequency of the secondary voltage when the ignition plug is generating the discharge.

$$0.95f_0<f_m<1.05f_0$$

10. The ignition device according to claim 2, wherein the second end of the secondary winding and the shielding part are grounded.

11. The ignition device according to claim 2, wherein a magnetic permeability of the core and a width of the gap of the core are determined so as to satisfy the following equations, where η is a gain of the secondary voltage due to resonance, $f_0$ is a driving resonance frequency which is a resonance frequency of the secondary voltage when the ignition plug is generating the discharge, and $f_s$ is a self-resonance frequency of the secondary winding.

$$\eta>1$$

$$f_s>f_0$$

12. The ignition device according to claim 3, wherein a magnetic permeability of the core and a width of the gap of the core are determined so as to satisfy the following equations, where η is a gain of the secondary voltage due to resonance, $f_0$ is a driving resonance frequency which is a resonance frequency of the secondary voltage when the ignition plug is generating the discharge, and $f_s$ is a self-resonance frequency of the secondary winding.

$$\eta>1$$

$$f_s>f_0$$

13. The ignition device according to claim 2, wherein a peak-to-peak value of a current supplied from the oscillator to the primary winding is set to 200 A or less.

14. The ignition device according to claim 3, wherein a peak-to-peak value of a current supplied from the oscillator to the primary winding is set to 200 A or less.

15. The ignition device according to claim 2, wherein the core is an EE core or an EI core with an initial relative permeability of 10 to 1500, and the width of the gap is 0.01 to 3 mm.

16. The ignition device according to claim 3, wherein the core is an EE core or an EI core with an initial relative permeability of 10 to 1500, and the width of the gap is 0.01 to 3 mm.

17. The ignition device according to claim 2, wherein the oscillator includes at least one half-bridge circuit, one end of the primary winding is connected between two switching elements constituting the half-bridge circuit, and the switching elements are turned on and off so that a potential on the side of the one end is alternately changed between positive and negative with reference to a potential at the other end of the primary winding.

18. The ignition device according to claim 3, wherein the oscillator includes at least one half-bridge circuit, one end of the primary winding is connected between two switching elements constituting the half-bridge circuit, and the switching elements are turned on and off so that a potential on the side of the one end is alternately changed between positive and negative with reference to a potential at the other end of the primary winding.

19. The ignition device according to claim 2, wherein a frequency of the oscillator is 0.1 to 20 MHz.

20. The ignition device according to claim 2, configured so as to satisfy the following equation, where $f_m$ is a frequency of the oscillator, and $f_0$ is a driving resonance frequency which is a resonance frequency of the secondary voltage when the ignition plug is generating the discharge.

$$0.95f_0<f_m<1.05f_0$$

* * * * *